US005578231A

United States Patent [19]

Schippers et al.

[11] Patent Number: 5,578,231

[45] Date of Patent: Nov. 26, 1996

[54] HEATER FOR AN ADVANCING YARN

[75] Inventors: Heinz Schippers; Karl Bauer; Johannes Bruske, all of Remscheid; Martin Fischer, Solingen; Benno Frank, Wuppertal; Siegfried Morhenne, Breckerfeld; Ralf Dedeken, Witten; Herbert Streppel, Remscheid, all of Germany

[73] Assignee: Barmag AG, Remscheid, Germany

[21] Appl. No.: 190,155

[22] PCT Filed: Feb. 11, 1993

[86] PCT No.: PCT/DE93/00118

§ 371 Date: Apr. 4, 1994

§ 102(e) Date: Apr. 4, 1994

[87] PCT Pub. No.: WO93/25738

PCT Pub. Date: Dec. 23, 1993

[30] Foreign Application Priority Data

| | | | |
|---|---|---|---|
| Jun. 6, 1992 | [DE] | Germany | 42 18 809.1 |
| Jul. 10, 1992 | [DE] | Germany | 42 22 631.7 |
| Sep. 24, 1992 | [DE] | Germany | 42 32 066.6 |

[51] Int. Cl.[6] ..... F27B 9/28; D01H 13/26

[52] U.S. Cl. ..... 219/388; 219/469; 392/417; 57/282

[58] Field of Search ..... 219/388, 469, 219/470, 471; 392/417; 57/284, 282

[56] References Cited

U.S. PATENT DOCUMENTS

| | | | |
|---|---|---|---|
| 3,420,983 | 1/1969 | McCard | 219/388 |
| 3,559,965 | 2/1971 | Kinyu | 219/388 |
| 4,027,467 | 6/1977 | Smith | 57/284 |
| 4,567,721 | 2/1986 | Kuroda | 57/284 |
| 5,148,666 | 9/1992 | Bauer et al. | 57/290 |
| 5,193,293 | 3/1993 | Gabalda et al. | 34/68 |
| 5,332,882 | 7/1994 | Gabalda et al. | 219/388 |

FOREIGN PATENT DOCUMENTS

| | | |
|---|---|---|
| 0332227 | 9/1989 | European Pat. Off. . |
| 0412429 | 2/1991 | European Pat. Off. . |
| 1204634 | 1/1960 | France . |
| 1937492 | 2/1970 | German Dem. Rep. . |
| 1303384 | 10/1971 | Germany . |

OTHER PUBLICATIONS

International Search Report dated May 13, 1993 of corresponding PCT Application, WO93/25738.

*Primary Examiner*—Teresa J. Walberg
*Assistant Examiner*—J. Pelham
*Attorney, Agent, or Firm*—Bell, Seltzer, Park & Gibson, P.A.

[57] ABSTRACT

A heater (1) for an advancing thermoplastic yarn which is guided along a heated surface over ring segments (2). The flow of heat to the yarn is adjustable by changing the geometric parameters of the heat transfer.

30 Claims, 10 Drawing Sheets

HEATER FOR AN ADVANCING YARN

BACKGROUND OF THE INVENTION

The invention relates to a heater for heating an advancing, thermoplastic yarn.

Such a heater is known from EP 412 429 and corresponding U.S. Pat. No. 5,148,666. It has the disadvantage that the curvature of the yarn path is invariably predetermined, and it simultaneously determines the distance of the yarn from the heated surface.

Such a heater is used, for example, in a false twist crimping machine.

However, also different applications are taken into consideration.

Heaters for heating advancing, thermoplastic yarns (synthetic filament yarns) false twist crimping machines include, in general, elongated rails which are heated to a certain temperature, and over which the yarn is advanced.

For the drawing and heat setting of a synthetic filament yarn, a heated tube is described in DE-AS 13 03 384 which is looped by the yarn in a steep helix. At the yarn outlet end, the tube is provided with a bead to prevent a movement in circumferential direction.

A thermoplastic material for the yarn includes in particular polyamide (PA6, PA6.6) or polyethylene terephthalate, but is not limited to these materials.

It is the object of the present invention to provide a yarn heating apparatus which is simple to assemble, and which makes it possible to vary the curvature of the yarn path within wide ranges and to ensure for each yarn path and in all points of the yarn path a distance from the surface, which is independent of the selected curvature.

SUMMARY OF THE INVENTION

The above and other objects and advantages of the present invention are achieved by the provision of a heater for heating a thermoplastic yarn which is advanced along and spaced-apart from a heating surface over ridge portions arranged on the heating surface. The heating surface is the curvilinear outer surface normal to the longitudinal axis of a heating tube. The ridge portions are ring segments which are mounted on the heating surface and extend at least partially around the circumference of the heating tube. Yarn guides at each end of the tube are offset in the direction of the circumference of the tube, and cooperate to guide the yarn helically along the tube such that the yarn contacts the ring segments without contacting the heating surface of the tube.

Moreover, a further development of the invention is to make it possible to influence the heat transfer for the respective case of application.

This heater allows to select by adjusting the yarn guides provided at the inlet and the outlet end of the yarn path, the slope of the helix in circumferential direction, at which the yarn passes over the rings of the tube, and thus the curvature of the yarn path. While, however, the curvature of the yarn path has a decisive influence on the heat transfer in the described and otherwise known heaters, this is not the case in the present invention. Here, the heat transfer is based exclusively on the temperature of the tube and the height of the rings above the tube. The slope of the helix, however, i.e., the curvature and the looping angle of the yarn path, can be selected without influencing the heat transfer such that the yarn advances in a smooth and stable manner, and that, moreover, in false twist crimping machines the twist imparted to the yarn is allowed to propagate unimpeded in the region of the yarn length which is exposed to the heater.

Thus however, also a clear adjustment of the temperature is made possible. Since the curvature of the yarn path is without an influence on the heat transfer, the yarn temperature is, besides the height of the rings (see above), dependent only on the temperature and length of the tube. The length and the looping angle are not dependent on each other. Consequently, the length may be selected such that it is possible to operate the tube in a temperature range which corresponds to the selfcleaning temperature of the heated surface, i.e., it is above 300° C.

One yarn guide respectively precedes and follows the heating tube of the present invention. Both yarn guides are offset from one another in circumferential direction of the heating tube, so that the yarn is advanced over the heating tube along a steep helix. Preferably, the heated tube is straight. A curvature is not needed, since the curvature of the threadline can be predetermined, as aforesaid, by adjusting the yarn guides.

The heating tube is heated from inside. This can occur preferably in that in the interior of the heating tube an electric resistance heater is provided, which extends at least over a portion of the length of the heating tube. In this instance, it is also possible to provide, for purposes of intensifying the heating in certain regions, for example, the inlet area, several activatable and controllable resistance heaters along the length of the heating tube. This will then allow to adjust different temperatures over the length of the heating tube.

It is provided and suffices that the yarn advances over the heating tube and the rings at a very acute angle with a generatrix of the heating tube. In view of the high temperature of more than 350° C., to which the heating tube can be heated, only a short length of the heating tube is necessary. Consequently, also the total looping angle of the yarn, related to the circumference and the length of the heating tube, is relatively small. Preferably, it amounts to less than 180° . Therefore, the heating tube forms in any event in this region the section of a cylinder. Its configuration as a circular cylinder has the advantage that the yarn rests over its entire length of contact on the outer surfaces of the rings with the same parameters of contact, in particular the same helix angle. However, also other, cylindrical configurations, for example, elliptical configurations of the heating tube are possible, in particular when, as will be described further below, the ring height is not constant in the region of the yarn path over the length of the heating tube. The portion of the heating tube, which faces away from the yarn path, may be constructed in any desired manner. A symmetrical configuration of the heating tube cylinder, in particular a circular-cylinder configuration of the heating tube cylinder will however be useful, when special importance is attached to a uniform heat distribution over the circumference and/or length of the heated tube.

In any event, the rings extend over the peripheral region of the heating tube which is in the vicinity of the threadline. They need not extend over the entire circumference of the heating tube and are therefore described, within the scope of the present application, as "ring segments." The possibility of a good heat transfer will result, when the rings extend only over the partial circumference of the heating tube which is contacted by the yarn. In this instance, the heating tube may be covered with an insulating layer on its flat side which faces away. The partial circumference, over which the rings extend, can be further reduced in that successive rings are offset relative to one another in the sense of the yarn path, i.e., they are helically offset relative to one another in the sense of the threadline. In any event, it is useful that the rings extend to a certain degree over the circumference, so that it is possible to preadjust the slope of the threadline within the desired range.

As aforesaid, it is particularly advantageous to operate the heater of the present invention at temperatures which are in the selfcleaning range. This means, the temperature is so high that polyester residues which adhere to the heater or the ridge portions during the heat treatment of thermoplastic yarns, decompose and oxidize. Thereafter, at most a light, mechanical cleaning is necessary. The temperatures for polyester and nylon are above 300°, and may also amount to 800°. The temperature limit, at which damage occurs, is dependent not only on the kind of polymer and the thickness of the yarns, but also on the length of the heater, the selected helix, and other parameters of the heating process.

The rings of the present invention may each extend in a normal plane of the heating tube. They are then rings in the strict meaning of the word.

However, the rings may also be inclined relative to the circumferential direction. For example, the inclined rings may extend in a group of parallel planes. An advantage in this instance is that the inclination of the rings relative to the curved, helical yarn path can be selected such that the yarn contacts the outer surface of the rings over a shortest possible length. This means: the inclination of the ring should be selected such that it is opposite to the slope of the yarn path, and that the yarn contacts each ring at an angle of 90° or an angle which barely deviates therefrom.

In one embodiment of the invention, the inclination is preferably selected opposite to the slope of the yarn path, both related to a generatrix of the heated tube. As a result, it is accomplished that the yarn contacts the ring over a shortest possible length. The helical or spiral ridge portion, also described as spiral, can be slipped, for example, in the form of a helical wire, on the circular-cylindrical heating tube, and be exchanged when it has worn out. The exchange of the overlying wire is simple to handle, as is its cleaning when a spring wire is used, which rests closely against the heating tube by its resilient contraction, and widens when compressed in longitudinal direction so much that the wire can be pulled off the tube.

In known heaters, in which the yarn is guided by means of ridge portions along a considerably heated surface, there is a disadvantage in that, while the surface and a part of the ridge portions have the necessary selfcleaning temperature, the ridge portions are cooled by the advancing yarn so considerably that the temperature drops below the selfcleaning range. In another embodiment, the ridge portions, over which the yarn passes, are formed by recesses which are formed in the heated surface of the heating tube, and between which one ridge portion remains respectively in axial direction, which extends in circumferential direction or is inclined thereto. These recesses may extend in circumferential direction and over the entire circumference, and appear in this instance as grooves. However, they may also extend over a partial circumference of the heating tube, namely the partial circumference which is provided for the helix of the yarn path. In this instance, the successive grooves are preferably arranged likewise offset in the sense of the helix.

Thus, the rings can be arranged in a normal plane, or extend in a group of inclined and parallel planes with respect to one another, or along a helix of the heating tube. In this instance, the foregoing description will apply to the direction of the helix. This configuration of the ridge portions is, also provided and likewise favorable for other heaters provided the heating surface itself is curved in the direction of the advancing yarn.

This embodiment results in a good heat transfer from the heating tube to the contact surfaces of the rings, so that it can be ensured that also the contact surfaces are always heated to the selfcleaning temperature.

Surprisingly, it has been found that a danger of burning does not exist for the yarn, even in the case of high temperatures and thin yarns, when, as is further proposed as advantageous, the ring height or respectively the depth of the recess is selected between 0.1 mm and 5 mm, preferably between 0.5 mm and 3 mm. The lower limit is predetermined by the radius of the heating tube and the slope of the helix, along which the yarn is guided, or respectively the curvature of the heating surface, as well as by the spacing between successive rings/ridge portions, and should be selected such that the yarn does not contact the heating surface itself.

The following should be emphasized: both the fact that ridge portions and the heating surface consist of one piece and, therefore, provide a good heat contact, and the fact that the ridge portions have only a slight height with respect to the heating surface, each alone and both combined, represent a significant improvement over the state of the art. These improvements can be applied advantageously in any type of high-temperature heater, in which the yarn is advanced in a curved threadline along a heating surface.

When subjecting synthetic fibers to a heat treatment, in particular synthetic fibers of small thickness (denier), the wear of the yarn-guiding surfaces plays a very important role for the quality of the product. This applies in particular to the false twist machine, in which the yarn rotates about its own axis in the region of the heater. To avoid a one-sided wear, it can be useful to adapt the heating tube of this heater for rotation. It is then possible to rotate the heating tube permanently or at certain time intervals, so that a new yarn path is formed.

However, because of the advantageous use of an electric resistance heater, such a rotation is possible only within limits. A remedy therefor is provided by the further development of the invention claims 6 and 11.

A relative rotation between ring and heating tube or respectively between sleeve and heating tube is naturally possible only when the heated tube is made circular-cylindrical. However, this is not necessary, when it matters primarily that worn rings are exchangeable.

The rings may be constructed as separate structural components and be threaded onto the heating tube. In this instance, the inside diameter of the rings is substantially equal to the outside diameter of the heating tube, so that a good heat-conducting contact exists between the heating surface and the ring.

The construction allows to exchange the rings individually, with the yarn-guiding portion of the rings extending only over a partial circumference of the heated tube. The construction further allows to accomplish that, nonetheless, the entire circumference is available to advance the yarn. The embodiment of claim 8 allows to adjust from ring to ring an always constant offset in the circumferential direction. Still another embodiment allows to select this offset.

To ensure an intimate heat contact between ring and heating tube on the side of yarn contact, each ring is pressed, by a spring clip against the heating tube. This spring clip abuts on the one hand against the side walls of the slot and with its central portion against the heating tube.

Also in the case of overlying ridge portions or rings, it is to be considered especially advantageous, when the height with respect to the heating surface is selected between 0.1 mm and 5 mm, preferably between 0.5 mm and 3 mm. Likewise in this instance, the lower limit is predetermined by the radius of the heating tube and the slope of the helix, along which the yarn is advanced, or respectively the curvature of the heating surface, as well as by the spacing between successive rings/ridge portions, and should be selected such that the yarn does not contact the heated surface itself.

In another embodiment at least the partial circumference of the heated tube, which is intended for the yarn path, is covered with a sheet (sleeve) which is closely fitted to the surface shape of the heating tube, and is in a close, heat conducting contact with the surface of the heating tube. It should expressly be emphasized that the sleeve need not extend over the entire circumference of the heating tube, but only over the portion of the heating tube circumference which faces the yarn path (heating surface).

However, the sleeve may also be constructed as a tube with a thin wall. In this instance, the inside cross section of the sleeve is closely fitted to the outside cross section of the heating tube. When the heating tube is made circular-cylindrical, it will be advantageous to also construct the sleeve as a circular-cylindrical tube, since this ensures a rotational guidance of the sleeve.

Formed on the outer jacket of the sleeve are rings which have the above-described shape. Preferably, the sleeve consists of a thin sheet. The rings may be formed in that the sleeve is compressed in several normal planes such that an annular bulge forms outwardly.

As a result, hollow spaces form which may hinder the transfer of heat. On the other hand, it is costly and difficult from the manufacturing viewpoint to apply, for example weld, massive rings to a thin-walled sheet for a good heat conduction. In another embodiment of the invention, a sleeve or a cage, whose inside diameter corresponds to the outside diameter of the heating tube, and whose jacket is provided with recesses of identical shape extending therethrough in an axial lineate succession, is slipped over the heating tube which has a substantially smooth surface. Preferably, the lines of uniform recesses are diametrically opposed in the sleeve, there being preferably arranged adjacent to these lines of successive recesses, lines with recesses having different shapes. If possible, the lines extend along parallel axes. Between successive recesses of one line, uniform ridge portions corresponding to the shape of the recesses, extend over the circumference. The sleeve is secured on the heating tube against axial displacement, but can be rotated. This results on the one hand in the advantage that a periodic or gradual rotation of the sleeve on the tube allows to guide the yarn always over a clean point of contact with the ridge portions. On the other hand, the yarn can be heated as a result of the different configuration of the ridge portions within wide temperature ranges. Since, in the sleeve, identical ridge portions or respectively recesses are diametrically opposed or respectively repeat at certain angular distances, they form paths of contact for two or more yarns. Otherwise, the ridge portions extending between the lines in the longitudinal direction of the sleeve, are of no significance for the essence of the invention.

In this instance, the sleeve is a sheet, into which several recesses are cut one following the other in the axial direction. These recesses are shaped such that between axially adjacent recesses a ridge portion remains which extends in circumferential direction. Also in this embodiment, the ridge portion need not lie in a normal plane of the heating tube, but may be inclined when related to a normal plane. Furthermore, it is not necessary that the ridge portions extend over the entire circumference. Rather, it is desired that the sleeve consists of one piece extending over the entire length of the heating tube, and that therefore likewise the recesses extend respectively only over a partial circumference/partial width.

As already noted above, a small ring height is not only possible, but also advantageous for making the temperature transfer uniform and for a good control of the temperature transfer to the yarn. For this reason, it is also here proposed as particularly advantageous to select the sheet thickness between 0.1 mm and 5 mm, preferably between 0.5 and 3 mm, while simultaneously referring to the aforesaid limits.

A previously described embodiment permits to vary the spacing of the rings over the length of the heating tube, as is described in more detail below. To enable such an embodiment also with the use of a sleeve, the a further embodiment is suggested. In this embodiment, the sleeve is divided into individual axial sections which are adapted to slide into one another in the fashion of a telescope. Each section is provided with a ring on its outer circumference. As a result of sliding the sections into one another to a greater or lesser extent, it is possible to vary the spacing of the rings.

The arrangement of ridge portions for guiding the yarn on a sheet which covers the heating surface, as well as the formation of the ridge portions by a sheet which is provided with recesses, offers the described advantages in any heater.

As previously indicated, a yarn guide is arranged both at the inlet end of the heating tube and at the outlet end thereof. The two yarn guides are offset relative to one another in the circumferential direction of the heating tube, so that the yarn advances in a steep helix over the rings. The slope of this helix and the radius of the outer surface of the rings determine the curvature of the yarn path. The curvature of the yarn path is again decisive for the stability of the yarn path. To be able to adapt the stability of the yarn path as regards other parameters which influence the stability of the yarn path (for example, yarn tension, twist level in the false twist crimping process), it is suggested that the yarn guides and the heating tube are arranged for displacement and positioning relative to one another in the circumferential direction of the heating tube.

As already noted above, it is advantageous from the viewpoint of heat engineering to heat the heating tube symmetrically. From the viewpoint of heat engineering, an excellent utilization of the heating tube results then from another embodiment, which permits the yarns to loop about the heating tube in a unidirectional helix. As long as the total looping angle of each yarn is smaller than 180°, it is possible to heat in this manner also more than two yarns on each heating tube. Naturally, this complicates the service and, in particular, the threading of the yarn. This applies especially, because for purposes of insulating, it is necessary to surround the heater with an insulating jacket which permits only a limited access to the heating tube. Such an insulating jacket surrounds advantageously the entire heating tube, and leaves open only a narrowest possible, radial slot which extends along a generatrix or respectively parallel to a generatrix of the heating tube. Such a configuration of the insulating jacket allows to thread several yarns however only to a limited extent. Another embodiment of the invention in which two yarns are threaded on the heating tube with an opposite slope, allows to thread these two yarns without difficulties in any desired sequence. In this instance, a yarn guide is provided for each threadline at the inlet and the outlet end. The yarn guides on the one side, for example at the outlet end of the heating tube, lie close to one another and substantially in the radial plane of the threading slot. The two yarn guides on the other side, in this instance at the inlet end of the heated tube, are in the operating position widely spaced apart symmetrically to the radial plane of the threading slot. Suitably, for threading a yarn, they can be adjusted between the radial plane of the threading slot and the operating position. Thus, it is possible to thread each yarn in the radial plane of the threading slot into the yarn guide at the inlet and the outlet end of the heating tube. Thereafter, one of the two yarn guides is moved in circumferential direction, thereby bringing the yarn on its path during operation. Both yarns may be threaded in this manner, one after the other, in any desired sequence.

In heaters for thermoplastic yarns, in which the temperature of the heating surface is substantially higher than the target temperature, to which the yarn is to be heated, a special problem consists in that the target temperature is by all means reached, but not exceeded. To this end, only the temperature of the heating surface and the yarn speed are adjustable as parameters, whereas the yarn thickness and the length of the heater are constant.

The optimization of the heating action on the yarn is however of great importance for the quality of the yarn and its texturing in the false twist crimping machine. For this reason, it is suggested that the contact length of the yarn guides be adjustable, thereby permitting also an optimal adjustment of the heating action on the respectively desired yarn speed and the yarn diameter (denier). To implement this, the proposal to configure the heater and the yarn guides such that the latter are exchangeable offers itself.

For an optimization of the heating action and adaptation to yarn speed and denier, it is further proposed as advantageous to adjust the ratio of the contact length of the yarn guidance to the contactless length of the heater (contact length), in particular in the region of the control zone. In this instance, for example, the heater may primarily have the shape of a tube. It is therefore possible to provide on the circumference of the heating tube several ridge portions/ring segments which widen in the circumferential direction. These ridge portions may be successively arranged on the circumference, one offset from the other. It is thereby accomplished that the yarn helically looping about the tube contacts the ridge portions one after the other in regions in which the ridge portions have substantially the same length of contact.

Therefore, the further development of the invention as claimed in claims 19–10, provides for a further adjustment parameter, which allows to influence the heat transfer to the yarn and, thus, the target temperature of the yarn. This parameter is the ratio of contact length/contactfree length of the yarn path along the heating surface, as well as the height of the rings/ridge portions above the heating surface or respectively the depth of the recesses, by which the rings or respectively ridge portions are formed. In these embodiments of the invention, the contact ratio and/or the height of the rings/ridge portions above the circumference of the heated tube or respectively the width of the heating surface crosswise to the yarn path vary.

Thus, the ring segments/ridge portions have crosswise to the direction of the advancing yarn a working width which amounts to a multiple of the yarn diameter. The contact length of the ring segments/ridge portions in the direction of the advancing yarn across the working width is different, and the yarn path can be adjusted relative to the working width of the ring segments/ridge portions.

The yarn path can be displaced relative to the circumference of the heated tube, or the rings/ridge portions arranged thereon, or the sleeve extending thereover. To this end, it is possible to adjust in all embodiments of the invention the inlet and outlet yarn guides synchronously in the circumferential direction. However, it is also possible to leave the position of the yarn guides unchanged and to rotate instead in circumferential direction the heating tube, or the rings placed thereon or the sleeve slipped thereover. In all these instances, it is a relative displacement of the yarn path on the circumference of the heating tube. This relative displacement may be done manually, it being possible to vary both the height and the width continuously or stepwise.

The advantage of this relative displacement consists in that it has a very direct influence on the heat transfer and, thus, also on the target temperature of the yarn. Thus, it becomes possible for the first time to measure the temperature of the advancing yarn continuously, and to control same by the relative displacement of the yarn over the circumference of the heating tube such that the target temperature remains constant at a predetermined desired value.

This means in the case of a heater with a sleeve placed thereon that the recesses increase and decrease in width crosswise to the direction of the advancing yarn. It is also possible and advantageous that in the sleeve differently shaped recesses extend side by side in the circumferential direction of the heating tube, i.e. transversely to the yarn path, that the ring segments/ridge portions have sectors, each having a constant radius/constant height, or that the width and/or height of the ring segments/ridge portions change only for one of the yarn heating zones, or that the width and/or height of the ring segments/ridge portions change differently for different yarn heating zones. This allows to accomplish not only changes in the heat supply for each yarn, but also relative changes of the heat supply for several yarns advancing simultaneously along the heater and, thus, a mutual adaptation of the target temperatures.

The effective yarn temperature and, thus, also the target temperature have a particular influence on the quality of the yarn in the false twist crimping process. For this quality, the yarn tension which is measured downstream of the friction false twist unit, was found to be an important indicator. It is therefore also possible to control the yarn tension and, in particular, the yarn tension which is continuously measured between the friction false twist unit and the delivery system downstream thereof, by the relative displacement of the yarn path on the circumference of the heating tube such that the deviation between the measured value and the desired value of the yarn tension does not exceed a certain tolerance value.

The presence of several yarn paths extending over a heating tube, creates the further problem of configuring the rings such that with a synchronous relative displacement of both yarn paths on the circumference of the heating tube, a desired, identical change follows in the ring height or respectively the depth of the recesses.

When a yarn advances over a heater and in particular the heating tube of the present invention, two essential functions result: It is necessary to transfer the necessary amount of heat to the yarn in the inlet region of the yarn path. In the outlet region, it matters that the heat distribution becomes uniform in the cross section of the yarn, so that the target temperature establishes itself in the entire cross section of the yarn. These two different functions result in that also the intensity of the heat transfer can differ in the different, longitudinal sections of the heated tube. This is accomplished in that the contact ratio and/or the ring height are formed differently.

The region of the tube length in which it matters greatly that the target temperature is reached over the entire cross section of the yarn, is described as end section in the present application. The section of the tube length, which is primarily concerned with the heat transfer, is described as control section. The contact ratio is substantially smaller in the end section, or respectively the ring height is by a multiple greater in the end section than the corresponding values of the control section.

The characteristic is that in the inlet region of the heater, the yarn has only little or no contact with the yarn guides, in that in this region the yarn guides are arranged only at a large distance. Preferably, the inlet region is provided only with one inlet yarn guide and one outlet yarn guide. Moreover, it turns out to be advantageous that the inlet yarn guide remains unheated. It is suggested for this reason that the inlet yarn guide be not in heat contact with the heating surface. As a result, the yarn guide remains substantially unheated, so as to cause thermoplastic material to separate. The yarn guide on the outlet side, however, is intended to have selfcleaning properties. Preferably, it is therefore connected directly with the heating surface and located at the beginning of the so-called "control section."

The control section is the portion in which the yarn obtains its desired temperature. It follows the inlet section of the heater. Several yarn guides are arranged in the control section. These yarn guides are spaced from one another equally or variably as is disclosed in the above-mentioned EP A2 0 412 429 and corresponding U.S. Pat. No. 5,148,666.

The use of yarn guides in the control section allows to ensure that the yarn is guided at a precisely defined distance from the heating surface. To ensure moreover that the yarn does not come into contact with the heating surface in the inlet section, it is further proposed to provide the heater between the inlet section and the control with a step, in such a manner, that the distance of the heating surface in the inlet section from the yarn path amounts to a multiple of that distance which the yarn path occupies from the heating surface in the control section.

This arrangement of the yarn guides allows to ensure that the yarn guides are arranged only in the zone, in which the attained temperature of the yarn on the one side, as well as the heater temperature on the other side ensure a selfcleaning. In this control zone, the temperature of the heater is accurately controlled, preferably by a control system. The precise guidance of the yarn relative to the heater allows to ensure here that the yarn assumes the predetermined, desired temperature. In the inlet section, the precise yarn guidance is foregone, in that use is made of the recognition that in the inlet section, the heating of the yarn occurs with great temperature gradients between heater and yarn, and therefore an accurate temperature control of the yarn is neither wanted nor possible.

The heating of the yarn in the control zone effects that, first, the outer layers of the yarn assume the desired temperature. Necessary however is a uniform heating of the yarn over its entire cross section. This goal is reached in that the control section is followed by an end section, in which the yarn guide is again arranged at a large distance, or however the yarn guide is absent. To avoid that the yarn comes in contact with the heating surface of the heater, the distance between the yarn path and heating surface should also here amount to a multiple of the distance which the yarn path and heating surface occupy in the control zone. This arrangement of the end section allows to ensure that when only little heat is transferred, heat losses are prevented and a uniform distribution of the heat supplied in the control section occurs over the entire cross section of the yarn.

In the inlet section, a great unsupported yarn length can be accepted, inasmuch as it has been found that in the inlet section, the tendency of the yarn to flutter is small. A length of 400 mm to 500 mm is possible. However, the length should be restricted for purposes of limiting expenditure to the measure which is necessary to attain the desired preheating of the yarn.

In any event, the end section is shorter than the inlet section. The length of the end section is preferably limited to 300 mm and should preferably be shorter.

As noted, an important field of application for a heater in accordance with the present invention includes the false twist crimping process, and in particular the false twist crimping process for draw texturing thermoplastic yarns, in particular polyester and nylon. In this process an undrawn or partially oriented (POY) yarn is supplied from a feed yarn package and withdrawn by a feed system. The yarn advances then through the heater and subsequently over a cooling plate adjacent thereto, and finally through a friction false twist unit. The yarn is withdrawn from the friction false twist unit by a delivery system and subsequently wound. A further heater and a further feed system may precede the takeup. As a result of the frictional action imparted by means of the friction false twist unit the yarn receives a twist in circumferential direction, which returns from the friction false twist unit to the heater and is again removed in the friction false twist unit.

The yarn may pass through the heater of the present invention at a speed of 1000 meters per minute and higher, without any friction or overheating problems arising.

The embodiments with overlying rings or sleeves also offer the possibility of rotating the yarn heating zones at certain time intervals below the advancing yarn, so as to achieve a regular selfcleaning of the yarn heating zones.

BRIEF DESCRIPTION OF THE DRAWINGS

Some of the objects and advantages of the invention having been stated, others will appear as the description proceeds when considered in conjunction with the accompanying drawings in which.

DETAILED DESCRIPTION OF THE PREFERRED EMBODIMENTS

Figure 1:
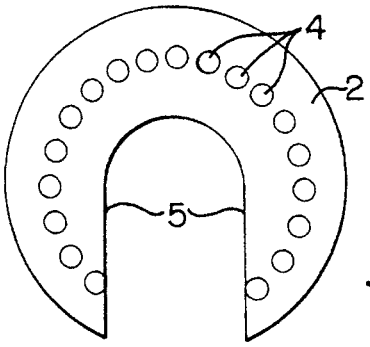
FIG. 1 is a top view of a ring for a heater in accordance with FIG. 3.

In the following description of the different embodiments of the invention like numerals are used for like parts.

All illustrated heaters are constructed as a tube 1, hereinafter heating tube. The heating tube is circular-cylindrical and straight. The tube may be configured as a body of rotation, a section, or a segment of a body of rotation, so as to obtain a yarn path along a spiral line, as is described further below.

The heating tube 1 accommodates in its interior one or several heating resistors 6 extending parallel to one another. The resistance heater is constructed as a cartridge and extends over the entire length of the heater. In the embodiment illustrated in FIG. 3, the heating resistors extend over the entire length of the heating tube. The heating tube 1 consists of a highly heat-conducting metal, such as steel or preferably of a copper aluminum alloy. Indicated at *6a* are the electrical supply lines. It should be noted that in practice the illustrated heater is enclosed in an insulating cage which has a radial slot for threading the yarn, and which forms a peripheral gap with respect to the heating tube. The yarn advances in this peripheral gap.

Arranged on heating tube 1 is a plurality of ridge portions. In the region of the yarn path, the latter are also constructed as ring segments which are also described as rings.

The circumference of the ring segments may be spherical. In outward direction, it is of a yarn-friendly, wear-resistant quality, i.e., it exerts on the yarn passing thereover a friction which is as negligible as possible. The circumference of the rings serves to guide a yarn 7 which advances through an inlet yarn guide 8 and an outlet yarn guide 9 over the circumferential surfaces of the ring segments. The inlet yarn guide is offset with respect to outlet yarn guide 9 in the circumferential direction of the heating tube. This means that the yarn 7 loops about the heating tube in a spiral line or helix, whose slope is dependent on the circumferential offset of yarn guides 8 and 9 from one another. This helix has a curvature which is dependent on the radius of the rings, the length of the heating tube or respectively the axial spacing of yarn guides 8, 9, as well as their circumferential offset. These dimensions are selected such that the radius of curvature of the threadline is between 5 and 25 mm, preferably between 10 and 25 mm. However, it should be emphasized in particular that the yarn does by no means contact the heating surface, i.e., the jacket of the heating tube. The diameter of the tube, the height of the rings above the jacket of the heating tube, as well as the slope of the helix, along which the yarn advances, are to be selected accordingly. At least one of the yarn guides is movable, preferably rotatable, relative to the other about the axis of the heating tube 1, so that the path of the advancing yarn over disks 2 can be varied by changing the pitch of the spiral formed by yarn 7.

The ring segments may extend as rings with respect to the entire circumference of the heating tube. This allows to use the entire circumference of the heating tube, either for several yarn paths or/and to shift a yarn path to less worn or soiled portions of the circumference.

The ring segments should extend at least over a sector angle of the circumference which is also covered by the helix of the yarn. This has the advantage that the yarn can be instantly threaded. When, in addition, the successive ring segments are offset in the sense of the threadline on the circumference, a relative displacement of the threadline to less worn and/or soiled portions of the ring segment circumference will likewise be possible in this instance.

When the successive ring segments with the pitch of the helix, along which the yarn is to advance over the circumference of the heating tube, are offset on the circumference, it is possible to reduce the length of the ring segments in circumferential direction to the length necessary for guiding the yarn. In this manner, the ring segments become elevations on the heating surface. Such a shortening has, however, the disadvantage that it will become only very difficult to thread the yarn, that the helix of the yarn is established by the succession of the shortened elevations and can no longer be varied, and that it is no longer necessary to evade to other areas of the circumference, when the yarn path is soiled.

Each ring segment lies in a normal plan of the heating tube, i.e., in a plane which vertically intersects the axis of the heating tube. However, when also other locations are conceivable and easy to realize from the manufacturing viewpoint, reference should be made in particular to the embodiments of FIGS. 4–6, as well as 20 and 21, which are described further below. In any event, the ring segments associated with a yarn path will always lie in a group of parallel planes. Should the ring segments of a generatrix of the heating tube not lie in a normal plane, i.e., they do not intersect a generatrix at 90°, it will be necessary to select the pitch of the helix of the yarn path opposite to the inclination of the rings with respect to the generatrix. In so doing, the pitch of the helix is defined likewise as the angle between the helix or threadline and a generatrix of the heating tube. The opposite inclination or pitch allows to obtain a short length of contact of the yarn on each ring segment and a reliable guidance on the ring segment.

Figure 2:
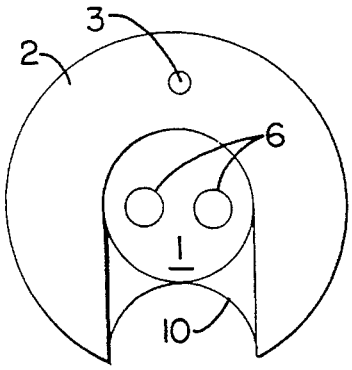
FIG. 2 is a sectional view along line II—II of FIG. 3.
Figure 3:
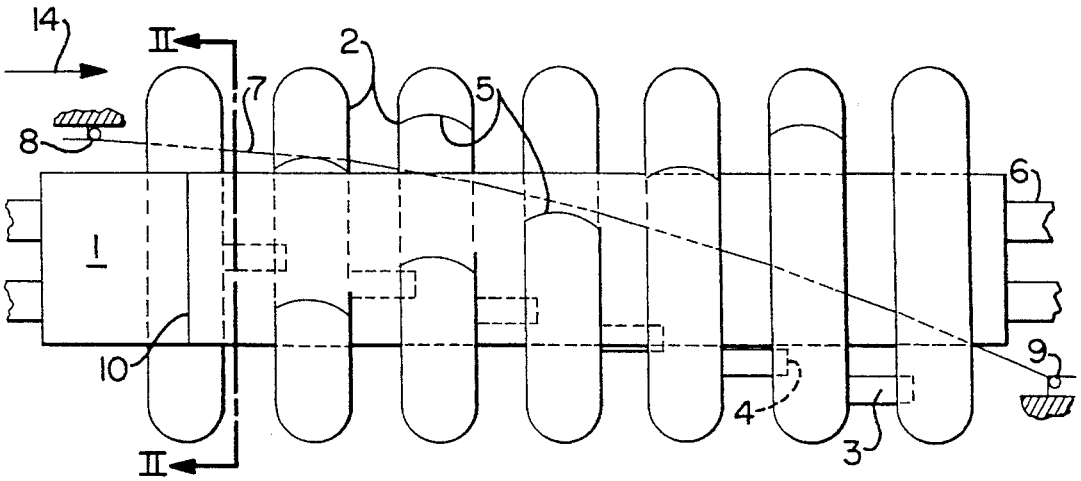
FIG. 3 is a side view of an embodiment of the heater in accordance with the invention.

The following applies to the embodiment shown in FIGS. 1–3, in which the ring segments are constructed as independent structural components in the form of disks and threaded onto the heating tube 1. The disks 2 shown individually in FIGS. 1 and 2, are provided in the simplest form with a circular-cylindrical hole which is closely adapted to the outside diameter of the tube. In this manner, it is possible to "string" the disks onto the heating tube. They are then in a highly heat-conducting contact with the heating tube. In the here illustrated embodiment, the disks are provided with a radial slot 5, whose inside width corresponds substantially to the diameter of heating tube 1, and whose opposing edges are parallel to one another. The outer edge of disk 2 is spherical. Located in the one front surface of the disks is a cavity or recess 4. From the opposite front end of disk 2 a pin 3 projects which serves as a spacer, and whose distance from the axis of the disk corresponds to the distance of recesses 4 from the disk axis. It will suffice to arrange in each disk respectively one of such recesses 4. Advantageous however is, as can be noted from FIG. 1, to arrange a plurality of recesses 4 along a circular line concentric to the axis of the heating tube, and equally spaced apart from one another and from the axis of disk 2.

The disks 2 are placed on heating tube 1 such that the pin 3 projecting from one disk 2 engages into one of recesses 4 of the axially adjacent disk. Preferably, the disks 2 are placed, in an even angular offset from one another, on the heating tube, so that the slots 5 and the pins 3 surround the heating tube in a spiral line. When, as shown in FIG. 1, a plurality of recesses is arranged on a circle, it becomes possible to adjust the spiral line, along which the slots extend, and adapt to the spiral line, along which the yarn advances over the heating tube (see below). To clamp the rings 2 on the tube, a wire-shaped spring clip 10 may be inserted into the slots 5, whose ends abut on the opposite slot walls, and whose central portion lies resiliently against tube 1.

The removal of this clip allows to take each of the disks from the tube and to replace same. This is especially important when one of the disks is excessively damaged by wear.

The yarn guides 8 and 9 are positioned on both sides of the slots 5, and the spiral of yarn 7 extends in the region of disks 2 located outside of the slots 5. The spiral line, along which the pins 3 and accordingly also the slots 5 extend, corresponds in the direction of pitch and substantially also in its pitch to the spiral line of the yarn path. This allows to accomplish that the entire circumference of the disks which remains outside of slot 5, is available to vary the path of the advancing yarn.

Preferably, the disks are made of a heat-resistant and nonscaling material, such as, for example, aluminum oxide or titanium oxide. To increase the abrasive strength of the disk edges, the latter may, if need arises, be coated with a suitable metal, and to increase their yarn-friendliness, the disk edges may be ground or polished.

Figure 4:
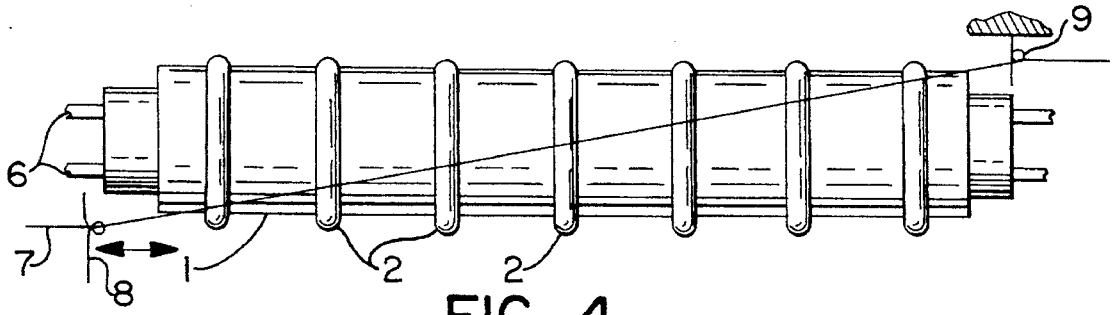
FIG. 4 is a side view of a further embodiment with rings of a small thickness.

The embodiment shown in FIG. 4 corresponds to that of FIGS. 1–3, and has the following characteristic: the rings 2 are firmly connected, for example by soldering, with the heating tube 1, and are equally spaced apart from one another. However, the rings 2 can also be formed by beads which are compressed into the heating tube at regular distances. Furthermore, the rings can be formed by circumferential grooves which are machined into the outer jacket of heating tube 1. The radially projecting circumferential surface of the rings 2 is spherical and of a yarn-friendly quality. The rings 2 serve to guide the yarn 7 at a distance over the heating surface, i.e., the jacket surface of the heated tube 1, with the path of the advancing yarn looping spirally about the tube 1. As schematically illustrated, located at both ends of heating tube 1 are the yarn guides 8 and 9, whose offset relative to one another determines the pitch of the spiral line or helix of the yarn path. At least one of the two yarn guides can be adjusted with respect to the other in the circumferential direction of the heating tube.

This allows to adjust the slope of the spiral line. Otherwise, reference is made to the description of FIGS. 1–3. The essential difference from the embodiment of FIGS. 1–3 consists in that the rings are firmly connected with the heating surface or respectively form a part of same. In particular, it is possible to manufacture the rings in that the heating tube is initially made with a thicker wall. Then, the regions of the heating tube which are to have a smaller diameter than the rings, are removed by turning, and the rings are machined out of the surface. All these versions of the embodiment of FIG. 4 produce a very excellent heat-conducting contact. This results in that the contact surface of the rings have substantially the same temperature as the heating surface. Consequently, when the temperature of the heating surface is adjusted to the selfcleaning range, i.e., above 300° C. to 350° C., the effect of the selfcleaning will also occur on the rings. This means that yarn remnants decompose, and can either be wiped off easily as ashes, or be even constantly entrained by the yarn, so that no notable soiling of the surface or yarn results.

In all the above-described embodiments of the invention, the rings lie in normal planes of the heating tube 1.

Figure 5:
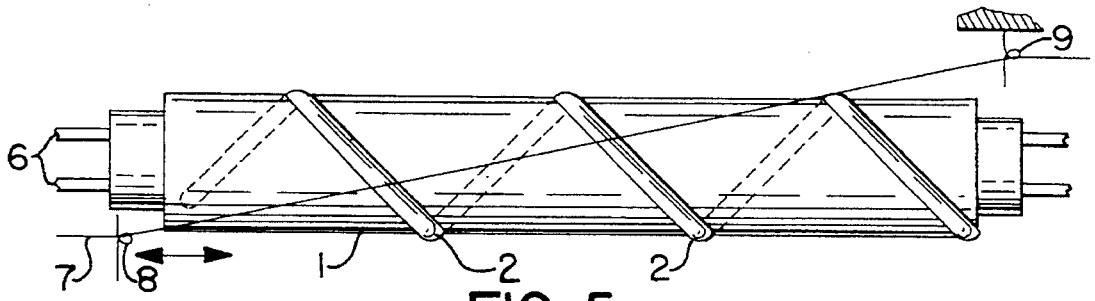
FIGS. 5–6 are side views of heaters with helicoidal rings.
Figure 6:
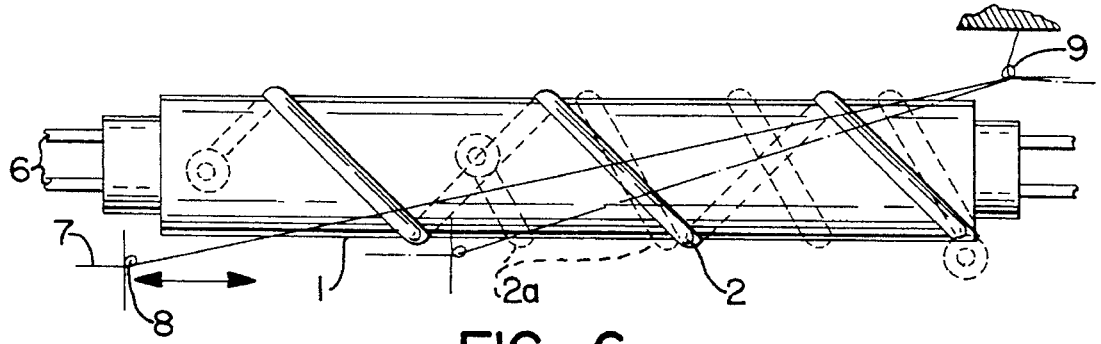

In comparison therewith, the embodiment of FIGS. 5 and 6 has the characteristic that the heating tube is surrounded over its entire length by one ring 2 which has the shape of a coil spring or respectively a helical or, synonymously, a spiral-shaped wire. This bead may be a wire which is firmly connected, for example by soldering, with the tube 1. However, the helical ring can also be formed in that it is machined out of the heating tube wall by removing a portion therefrom. This embodiment results in an especially highly heat-conductive contact between the ring and the heating tube with the aforesaid advantages.

In the embodiment of FIG. 6, the helical bead consists of a wire of a flexible, elastic material. This spring wire is configured such that it can be slipped on the jacket surface of the heating tube 1, and fits over the jacket surface resiliently, tightly, and with an excellent heat contact. The inner side of the wire should therefore be as flat as possible.

The pitch of the wire 2 extending helically about the heating tube 1 may be varied in that one of its ends can be rotated with the respect to the other on the jacket surface in circumferential direction, and that it can be shifted in axial direction. As a result, the pitch and length of heating tube 1, over which the here-described yarn guiding spiral extends, change. Widenings or narrowings of the cylinder which is surrounded by the here-described yarn guiding spiral, and which should correspond to the outer jacket of the heating tube, can again be removed by a relative adjustment of the two spiral ends in the circumferential and/or the axial direction of the tube 1, so that the spiral remains adapted to the diameter of tube 1.

In FIG. 6, the helical yarn guide 2 is shown in solid lines in a drawn-out position, and in dash-dotted lines **2*a* in a compressed position. Widenings or narrowings which result from this change of the spiral, are compensated by a relative adjustment of the spiral ends in the circumferential direction of heating tube 1**.

Likewise, in the embodiments of FIGS. 5 and 6, the yarn 7 is guided along a spiral, whose pitch is opposite to the pitch of the spiral-shaped bead which in this instance forms the rings 2.

As a result, it is accomplished in both embodiments that the contact surface between the yarn and ring or respectively bead or respectively wire remains as short as possible on the individual points of contact. Obvious on the other hand here is the advantage that a slight change in the yarn path results in a considerable change of the contact surfaces. Furthermore, an advantage of the embodiment of FIG. 6 also consists in that it is in this instance possible to change the density, at which the yarn comes in contact with rings or respectively guide surfaces of the spiral. In particular, it is possible to predetermine ranges with a great density of rings. This is especially important in the control section of the length of the heating tube. In other longitudinal sections, in particular the inlet and outlet end sections, no rings are provided in this instance.

This can be accomplished either by rotatably arranged inlet and/or outlet yarns guides 8, 9 in cooperation with a stationary heating tube 1, or by stationarily arranged inlet and/or outlet yarn guides 8, 9, together with a heating tube 1 rotatable about its own longitudinal axis, or by rotatable inlet and/or outlet yarn guides 8, 9 in cooperation with a rotatable heating tube 1.

Figure 11:
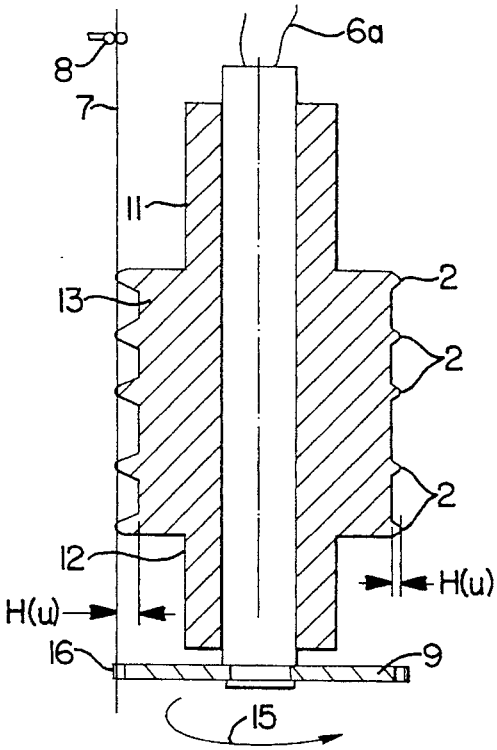

In the embodiment of FIG. 11, only the outlet yarn guide 9 is rotatable relative to the tube, whereas the inlet yarn guide 8 is stationarily mounted.

Figure 7:
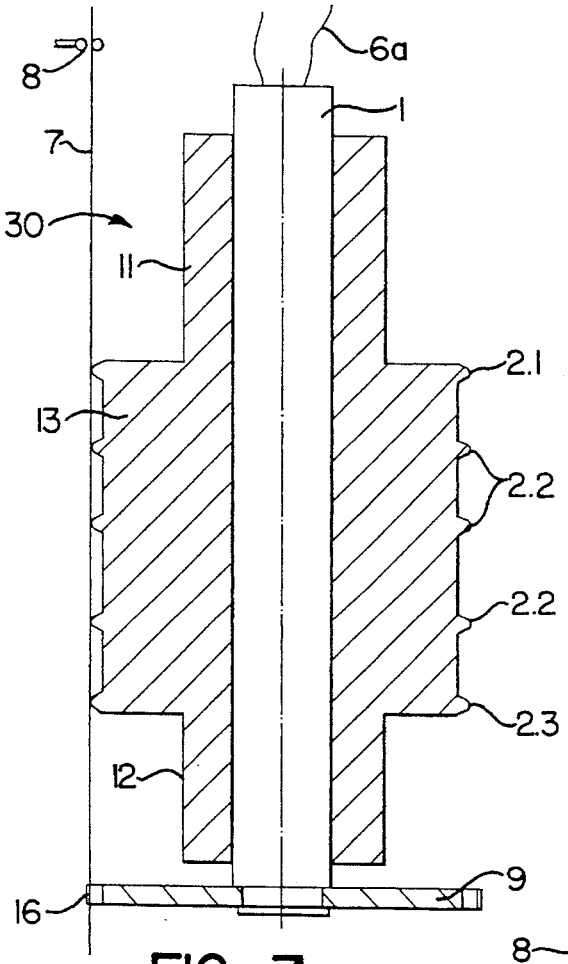
FIGS. 7–8 are an axial sectional and a perspective view of an embodiment with several heating zones.

In the embodiment of FIG. 7, the outlet yarn guide 9 formed by a notch 16 is coaxially and rotatably arranged at the lower end of heating tube 1, and rotatable in a range 15 relative to the tube.

As can be noted, upon a rotation of the outlet yarn guide 9 relative to the tube, the yarn 7 describes a spiral on the rings 2, whose geometry (winding, pitch) is dependent on the rotated position of notch 16 on outlet yarn guide 9.

As described above, the embodiments of FIGS. 4 and 5 have the characteristic that the jacket of the heating tube and the rings consist of one piece, i.e., they are firmly connected with the jacket, either by soldering or welding, or however by a corresponding shaping on the heating surface, or they are even machined out of the jacket. This characteristic also applies to the embodiments of FIGS. 7 to 18A–E. This concept of the invention can basically be applied to all heaters, in which the yarn is advanced by means of ridge portions along a heating surface, preferably a heating surface which is curved in the direction of the advancing yarn. In particular, however, it is possible to apply this concept of the invention to all heaters in accordance with the invention. Added to this, however, is a further measure which can be applied in addition or as an alternative, even in the embodiments of FIGS. 3, 4, and 5. This measure is the following: the rings have only a very small height. Insofar, their illustration in all FIGS. 3 to 5 is exaggerated. The height of the rings above the heating surface (jacket of the heating tube), which is equal to the difference between the radii of ring and heating tube jacket, amounts to as little as 0.3 mm, and does not exceed 5 mm, preferably not 3 mm. A favorable range is from 0.5 mm to 3 mm. The smallest height is selected such that between the rings the yarn does not contact the heating jacket. The smallest height is therefore dependent on the spacing of the rings and on the radius of the heating tube jacket. This dimensioning ensures on the one hand a good heat transfer to the outer circumference of the rings, so that, there, a selfcleaning temperature, or in any event a very high temperature is always present. 0n the other hand, however, it also ensures that the yarn is advanced in the sense of the marginal zone of the heating tube jacket, in which no disturbing air convection exists. There, the yarn is exposed only to the heat radiation from the heating surface, i.e. the jacket of the heating tube. There, no air currents exist, which lead to a cooling or uncontrolled temperature control.

This concept of the invention is basically applicable to all heaters, in which the yarn is advanced by means of ridge portions along a heating surface, preferably a heating surface which is curved in the direction of the advancing yarn. In particular, however, this concept of the invention can be applied to all heaters in accordance with the invention.

Figure 8:
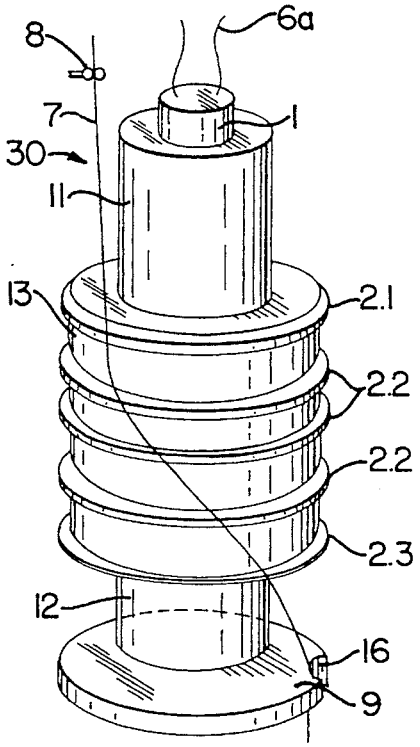

The embodiment of FIG. 7 and 8 has moreover the following characteristic:

The yarn 7 advances first through inlet yarn guide 8, and arrives then at the circumferential range of the tube. The yarn is guided by yarn guide 9 at the outlet end with axial and circumferential components along the tube. The yarn guide 9 is in this instance a disk rotatable about the tube axis with a yarn guide notch 16. Shown in FIG. 7 is in simplified form an aligned position of the inlet yarn guide 8 and notch 16. FIG. 8 shows that the disk 9 is rotated such that the yarn, as aforesaid, is guided with both an axial and a circumferential component over the tube and, thus, describes a steep helix. The adjustment of disk 9 permits to adjust the looping of the yarn about the tube in circumferential direction. The looping is synonymous with a curvature of the yarn. Therefore, the looping permits the yarn to rest flat against the tube or the yarn guide rings mounted thereon.

The heater comprises three sections or zones, i.e. an inlet section 11, a control section 13, and an end section 12. Both yarn guide 8 and the first ring of the control section 13 serving as a yarn guide 2.1 advance the yarn over the inlet section 11.

If possible, the inlet yarn guide 8 has no contact with the heater. This accomplishes that the yarn guide 8 is not heated. Therefore, no sediments form on yarn guide 8, which develop when the yarn is heated. As aforesaid, the outlet yarn guide of inlet section 11 is formed by the first ring 2.1 of control section 13.

The heating surface directed toward the yarn, i.e., the jacket of inlet section 11 is at a distance from the yarn, which amounts to a multiple of the distance which the yarn has from the heating surface, i.e., the jacket ranges of the control section extending between rings 2.1, 2.2, 2.3. The distance of yarn guide 8 from the first yarn guide 2.1 of the control section amounts likewise to a multiple of the spacing of the yarn guides in the control section. In this instance, lengths of up to 500 mm can be accepted. The length is here highly dependent on the tendency to vibrate. Preferably the length of the inlet section 11 is selected smaller, and at least such that an efficient preheating of the yarn is possible.

The temperature control of the heater comprises a sensor not shown which detects the effective actual temperature of control zone 13. This temperature is controlled. Therefore, the control zone has a very accurate temperature control.

Arranged in control zone 13 is a plurality of yarn guides 31. In accordance with the invention each of these yarn guides 31, including the first yarn guide 31.1, are constructed as rings which extend at least over a partial circumference of the control section. These rings have a certain, predetermined spacing, as well as a certain height above the remaining jacket portion of the control zone 13. The number of the rings is determined by the tendency of the yarn to vibrate as well as by the heat transfer. The height of the ridge portions with respect to the jacket of the control zone is selected small and amounts preferably to at most 3 mm. It is preferably smaller than 1.5 mm, but greater than 0.3 mm.

These rings are machined out of the jacket of the control zone. As a result, they possess a highly heat-conductive contact with the heater. Their small height allows to ensure that the control temperature also prevails in the contact surfaces. As a result, it is ensured that the heater temperature which is above 300° C. and selected so high that it leads to a cracking and burn-off of adhering yarn remnants, is present even in the contact surfaces of the ridge portions 31.2, 31.3. Consequently, these yarn guides have excellent selfcleaning properties.

The width of the rings in direction of the yarn is, as in all embodiments, likewise decisive for the heat transfer.

For the protection of the yarn, this contact length is selected short, it being necessary to make a compromise with the requirements of the heat transfer. The axial spacing between two ridge portions (spacing of yarn guides) has likewise an influence on the heat transfer. As a whole, it is possible to apply a ratio of contact length/spacing of yarn guides of up to 20%, preferably, however, this ratio is smaller, preferably smaller than 10%.

The distance of the heating surface, i.e., the jacket of the inlet zone, amounts to 3–10 times of the height of the rings 2 with respect to the jacket of the control zone. Insofar the illustrations of the drawing are not true to scale.

In the end section, the yarn is again guided by only few yarn guides, in this instance by ring serving as outlet yarn guide of the control zone, as well as the above-described disk 9 with its yarn guide notch 16. The spacing between the yarn path and the jacket of the end section 12 is again by a multiple greater than the height of the yarn guide rings 4 with respect to the jacket of the control zone. Also here, the same rules of dimensioning apply as those for the inlet zone 11. Viewed as a whole, the spacing of the yarn guides in the end section is however smaller than in the inlet section. The spacing of the yarn guides amounts to 300 mm, and is preferably smaller. The disk 4 which is located on the heating tube, is likewise heated to the selfcleaning temperature by heat transfer.

Otherwise, the configuration of the rings corresponds to that described with reference to FIG. 1–6. As shown in FIGS. 7 and 8, the rings with the jacket of the heating tube are made of one piece.

Figure 9:
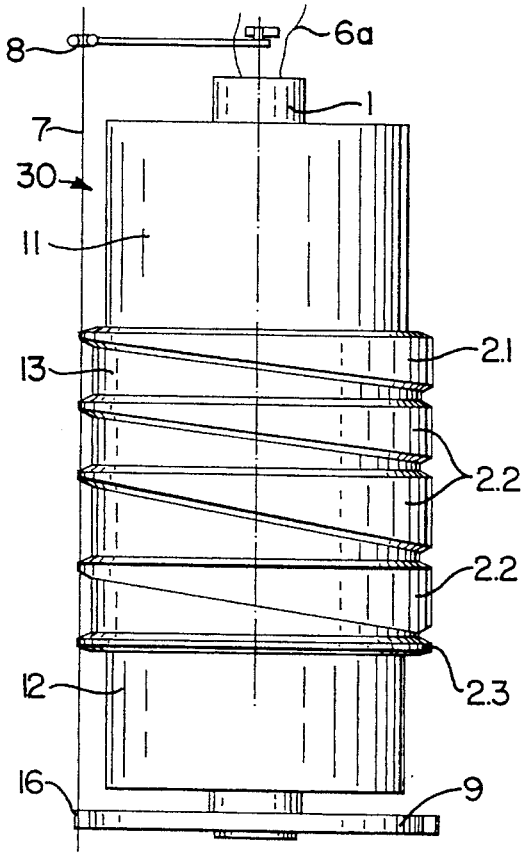
FIG. 9 is a side view of a heater with the contact lengths of the ridge portions varying in the circumferential direction.

As regards the embodiment of FIGS. 9 as well as 10–11, the following applies:

Likewise as in the embodiment of FIGS. 7–8, the heaters comprise respectively at the inlet end of heating tube 1 and/or outlet end of same an inlet section 11 and an end section 12 which have a greater radial distance from the advancing yarn 7 than the jacket surface of heating tube 1.

Located between the inlet section 11 and end section 12 is the control section 13 which in the present case has a further characteristic. The latter, however, is applicable not only to the embodiment illustrated in FIGS. 7–8 or respectively 9–11 with a special inlet section, control section, and end section, but also in the case of an even or in another way uneven distribution of the rings.

Figure 10:
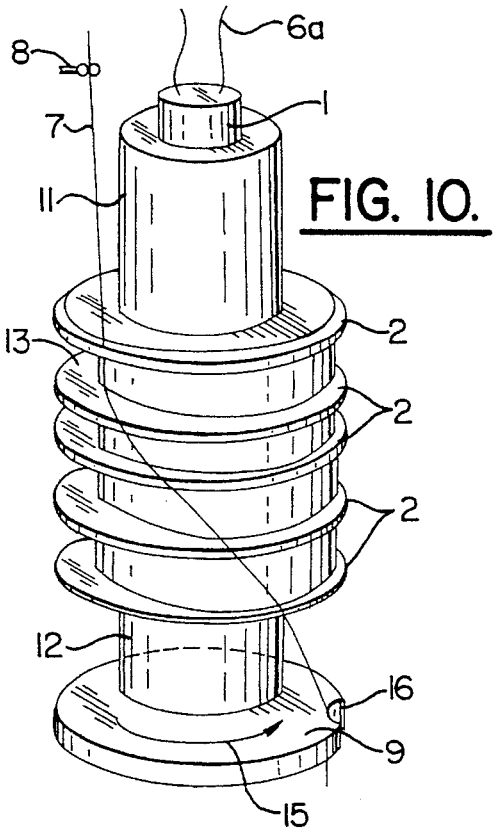
FIGS. 10–11 are a perspective side view and an axial sectional view of an embodiment with the heights of the ridge portions varying in circumferential direction.

As can be noted, among other things, from FIG. 9, in both the embodiment of FIGS. 10–11 and the embodiment of FIG. 9, the inlet yarn guide 8 and the outlet yarn guide 9 are rotatable relative to heating tube 1, thereby forming a sector angle on the surface of rings 2, which is covered by yarn 7 as a result of the range of rotation 15. This results in the formation of a zone of possible contact between the yarn and the rings.

Consequently, the yarn 7 is permitted to advance along any desired points within the predetermined sector angle, as a function of the respective, rotated position of the yarn guides 8, 9 and tube 1 relative to one another.

The characteristic of FIG. 9 is the circumferential configuration of the rings 2.1, 2.2, and possibly 2.3, which serve as yarn guides. In the circumferential direction, the ridge portions occupy an increasing axial extension (width), with the narrowest point being located not, as could be noted from FIG. 18, precisely on a generatrix, but essentially on a line which is substantially parallel to the contact line of the yarn. This contact line of the yarn may be changed, though. In this instance, it is necessary to select a contact line corresponding to normal operating conditions. Accordingly, in FIG. 9, not only is the outlet yarn guide in the form of disk 9 with yarn guide notch 16 rotatable about the axis of the heater, but also yarn guide 8. This allows to displace the yarn path on the circumference of the heater to an area, in which the contact length of yarn guide rings 31 has a desired dimension, and in which a desired ratio of contact length to free guide length exists between the ridge portions. As a result, it becomes possible to influence not only the heat transfer, but also the smooth run of the yarn. On the other hand, a too great contact length leads to high yarn frictions, which is undesired for the protection of the yarn.

Figure 12:
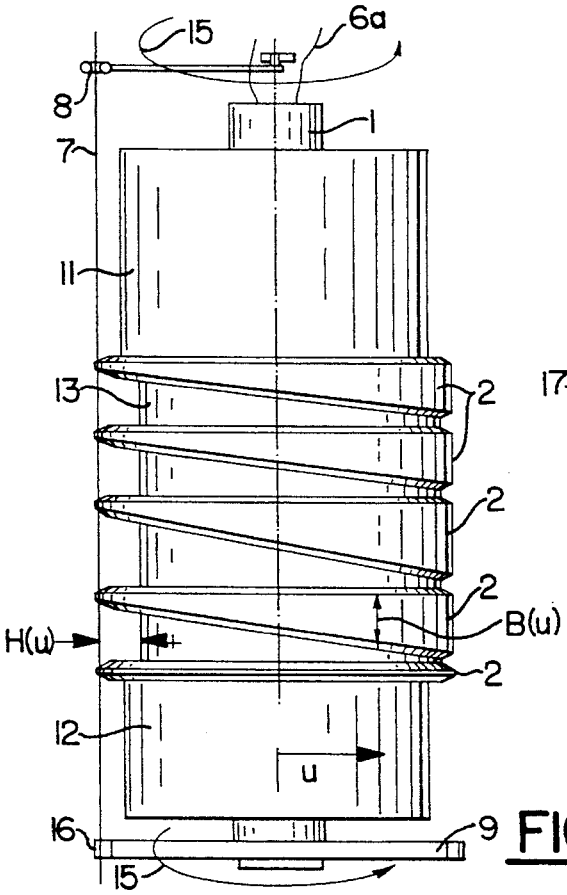
FIG. 12 is a side view of an embodiment with the contact lengths and contact heights of the ridge portions varying in the circumferential direction.

Thus, the embodiments of FIGS. 9 and 12 comprise rings of a width which varies in circumferential direction over the sector angle covered by the yarn 7. This means that the width B of a ring changes in dependence on a circumferential coordinate u in accordance with a function B (u), which can in each case be predetermined. In this instance, the function progresses linearly.

Further shown in FIG. 12 is the characteristic that the rings 2 have in the possible range of contact with yarn 7 a height H which varies in the circumferential direction. This means that the height M is a function of the circumferential coordinate u which is accordingly indicated at H(u).

In the embodiment of FIG. 9, the width B of the rings increases in that circumferential direction, in which the height H of the rings decreases. It is therefore to be expected that, as the contact time of yarn 7 on the rings increases due to the increasing ring width B, the heat flow to the yarn increases likewise in the contactfree longitudinal areas between the rings 2 due to the simultaneously decreasing distance between yarn 7 and the tube jacket.

Figure 14:
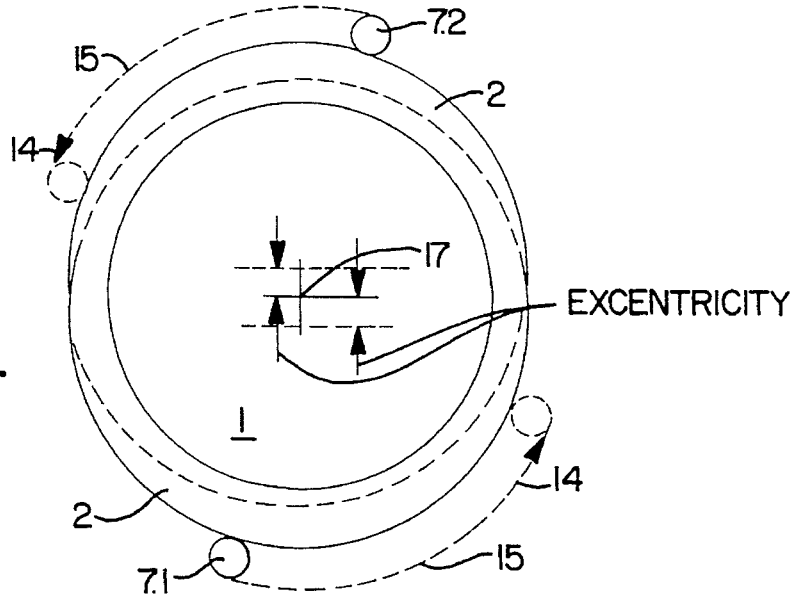
FIG. 14 is a top view of a heater with varying height of the ridge portion and two yarn paths.

Supplementing the foregoing, FIGS. 10 and 11 show that the rings 2 can have in the sector angle, which can be covered by the yarn, a height which varies in circumferential direction, even when the width of rings 2, i.e, the width of the ridge portions, does not change in the circumferential direction, as is described in more detail below in particular with reference to FIGS. 14 and 18.

Thus, it should explicitly be stated that these two embodiments of the invention, namely rings with varying width and rings with varying height, can result both in combination with one another and separately from one another.

The width B of the rings can also change in steps. This means that the width B is constant over lengths and increases at the certain circumferential coordinate in steps, for example, from a smaller width to a greater width.

Analogously, the foregoing paragraph applies likewise to a change in the height H of the rings. This allows a slight lateral adjustment of the zone of contact between the yarn and ring to remain without influence on the heat transfer between the heated surface and the yarn.

In the embodiments of FIGS. 9–11, the rings are formed in that annular grooves are machined into the tube jacket such that the rings of the present invention remain, over which the yarn 7 advances. In the embodiment of FIGS. 10, 11, the grooves on the circumference of the heating tube jacket have a different depth, and a different width in FIG. 9.

In operation, the heat is transferred on the one hand from heating tube 1 to yarn 7 in the zones of contact which the rings 2 form with yarn 7.

Furthermore, heat flows to yarn 7 in the longitudinal areas between the rings 2, which are not contacted by the yarn. Since the bottom of the annular grooves between rings 2 has a distance from the advancing yarn of at most few millimeters, starting, for example, with 0.3 mm and increasing to approximately 5 mm, it is presumed, in view of the heating temperature of heating tube 1 of 300° C. or more, in particular, temperatures on the order of the selfcleaning temperature, that an effective flow of heat also occurs in the contactfree longitudinal areas.

The heat flow being effective on the yarn as a whole is consequently a function of the respectively adjusted geometry of the yarn advance with respect to the tube geometry, because the lengths of contact and the contactfree longitudinal areas are, just as well as the ring height, dependent on the relative adjustment of inlet yarn guide 8 or respectively outlet yarn guide 9 with respect to the heating tube 1. The ratio of contact and the height of the rings are thus decisive parameters for the heat transfer, the contact ratio being understood to be the quotient of the contact length of the yarn on each ring, and the length of the subsequent, contactfree spacing from the next ring.

Rings having a different height over the circumference can be manufactured, for example, in that the rings are made circular-cylindrical, but are arranged eccentrically with respect to the tube axis. However, the rings may also be formed elliptically or in any other manner.

Such variations of the heat transfer are described further below with reference to FIGS. 14–18A–E, as well as 21.

Thus, it is possible to adjust the respectively transferred heat flow very sensitively by displacing the yarn path on the circumference of the heating tube. Already slightest changes in the rotated positions relative to one another effect noticeable changes in the heat flow being effective as a whole and the obtained yarn temperature.

The present invention avails itself of this recognition by applying it to a false twist texturing machine, as is described in more detail below.

It has been indicated already above that the yarn advances along a spiral or helical threadline along the heating tube. If, in the embodiments of the heating tube as shown in FIGS. 9–11, in which the rings have a contact width varying in the circumferential direction and/or a height varying over the length of the heating tube jacket, importance is attached to the fact that the yarn along the threadline contacts the rings always at points of identical contact width, or respectively identical height, the rings following one after the other will be offset with respect to their contact width or respectively contact height in the circumferential direction in the sense of the helical threadline. If the slope of the threadline can be adjusted by displacing one of the yarn guides 8 or 9, it will suffice to offset successive rings in the meaning of the mean value of the pitch, to which the helical threadline can be adjusted. It will then result that successive widths or respectively heights of contact are in any event approximately of the same size.

Instead of a graphic illustration which is very complicated and unclear, one should assume that in FIGS. 9–11, the successive rings 2.1, 2.2, 2.3 etc. are offset in circumferential direction respectively by a certain angle value. This angle value corresponds to the aforesaid mean value of the adjustable pitch of the helix described by the yarn.

However, one may also intentionally forego this circumferential offset of the rings and arrange the rings one after the other such that the points of same width and/or same height extend along a generatrix of the tube. Such a measure allows to configure the contact ratio and/or the height of the rings differently along the yarn path and, thus, also the heat transfer over the length of the yarn path.

All embodiments of the heater in accordance with the invention permit to heat at least one advancing yarn. The arrangement of several pairs of inlet yarn guides 8 and outlet yarn guides 9 on the circumference, however, also permits to treat a correspondingly larger number of advancing yarns at the same time. To this end, it is obvious to offset the outlet yarn guides 9 with respect to the inlet yarn guides 8 respectively in the same sense on the circumference. In this instance, all yarns advance along a unidirectional helix over the circumference of the tube. In comparison therewith, the development illustrated in FIG. 13 shows an embodiment, in which two yarns advance with an oppositely directed pitch along their helix.

Figure 13A:
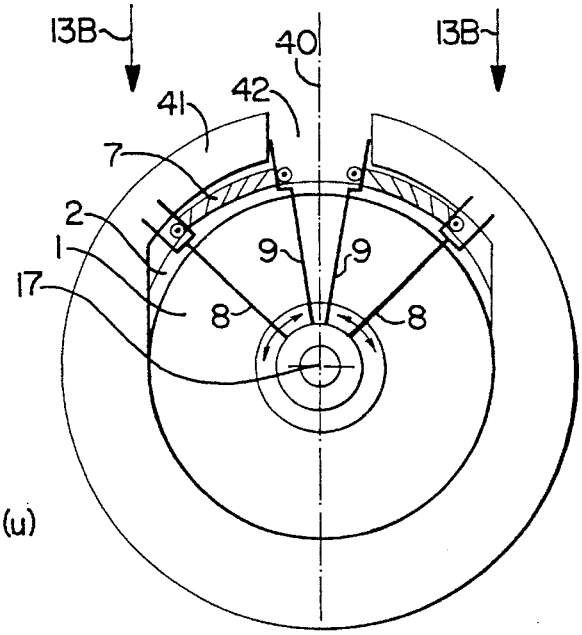
FIGS. 13A–B are a top view and a front view of a heater with two yarn paths.
Figure 13B:
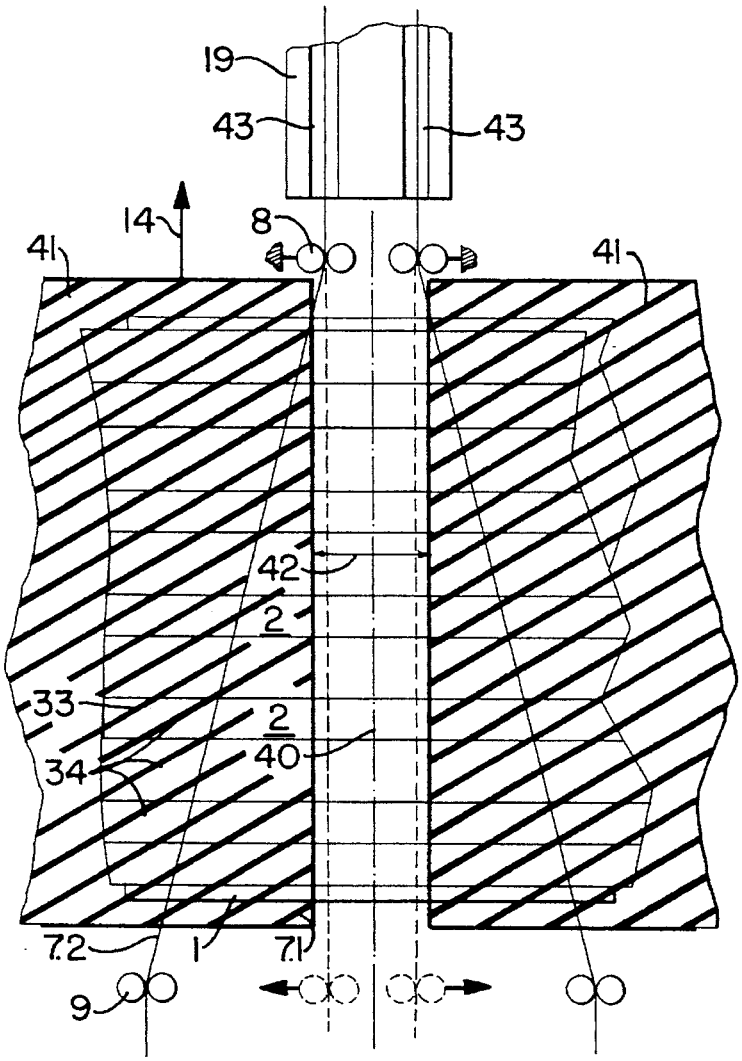

The following is a description of FIGS. 13A and 13B.

Shown in FIG. 13A is a normal sectional view of such a heater, including an insulation 41 which surrounds the heating tube. FIG. 13B is a side view of the heater illustrated as a development and directed to a threading slot 42 of the insulation.

The insulation 41 surrounds the heating tube 1 as a tubular body. This tubular body 41 is provided with a longitudinal slot 42 along a generatrix. This longitudinal slot has a width of few millimeters so as to avoid heat losses. Naturally, the insulating body 41 is closed on its front surfaces likewise by an insulating layer not visible in FIG. 13A. The width of slot 42 is exaggerated in FIGS. 13A and 13B. The outlet yarn guides 9 are stationarily arranged and lie within the slot width. However, they may also be displaceable between the illustrated position and a position facing away from the center line 40 of slot 42. As aforesaid, in FIG. 13B the insulating body 41 is shown as a development and recognizable by the contour shown in bold lines.

In any event, the inlet yarn guides 8 can be displaced from their threading position, which is shown in dashed lines in FIG. 13B, in opposite direction (arrows) to their operating position (arrows).

It is also possible to recognize through insulation 41 the underlying portion of the heating surface of the heating tube, which is per se invisible.

As can be noted from FIG. 13A, the insulation 41 forms with the heating tube or respectively the overlying rings, a narrow gap in the circumferential region in which the yarn is displaceable. When displacing the yarn guides 8 in opposite direction from their threading position in alignment with the slot 42 to their operating position, the yarns advance on the circumference of rings 2 along a helix, with the helices of the two yarns having an opposite pitch.

When the outlet yarn guides 9 are also displaceable from their threading position in alignment with longitudinal slot 42 in opposite direction to an operating position, it will naturally be necessary to displace the inlet yarn guides 8 all the further, so as to obtain for each of the yarn the helical threadline with the desired pitch. It should be remarked that the two yarn guides 8 and 9 may also be arranged stationarily in the indicated operating position. This applies all the more, inasmuch as it is also possible to physically replace the outlet yarn guides 9 with the grooves of a cooling plate 19 shown in FIG. 13B, but need by all means to be aligned with the grooves. In this instance, the advancing yarn, which has been withdrawn and is guided by a suction gun for purposes of threading, is first placed in the inlet yarn guide, then guided through the longitudinal slot 42, and thereafter drawn laterally and inserted into outlet yarn guide 9 which in any event is aligned with the longitudinal slot 42 or arranged in its vicinity.

Already described were embodiments, in which in the circumferential direction of the heating tube 1, the contact ratio and/or the height of the rings changes, so that as a result of displacing the threadline in circumferential direction, it is possible to change the applied amount of heat. Schematically shown in FIGS. 14, 15, 16, 17, and 18 A–E are possible embodiments for such rings, in which two yarns are heat treated on the heating tube.

In the embodiment of FIG. 10, the rings 2 are eccentric with respect to the tube axis 17, with the eccentricities of successive rings being respectively offset by 180° relative to one another.

This embodiment has the advantage that by a relative rotation in the same direction between heating tube and yarn paths 7.1 and 7.2, the height ratios of the rings on the yarn contact points change symmetrically and in the same manner.

Figure 15:
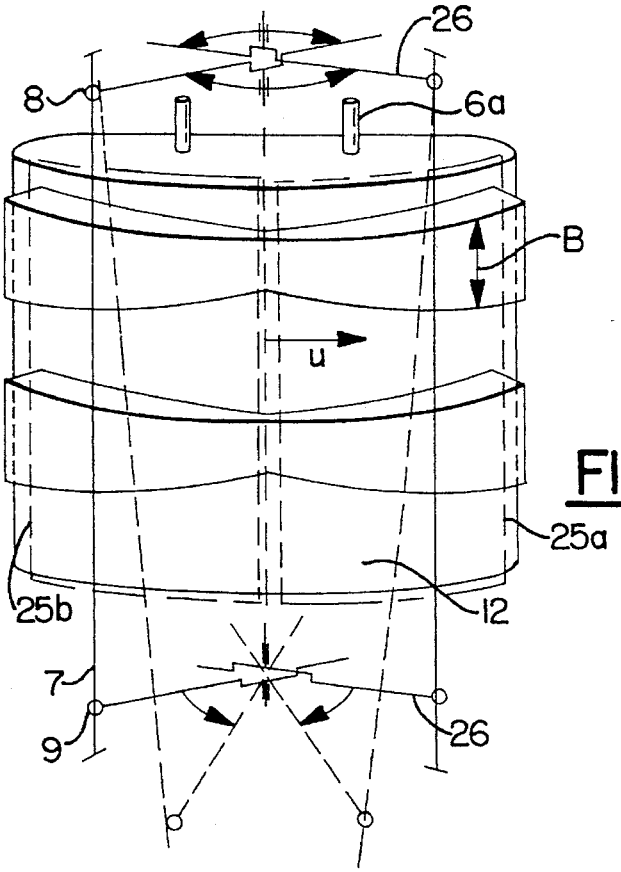
FIGS. 15–17 are side views of heaters with varying height of the ridge portion and two yarn paths.
Figure 16:
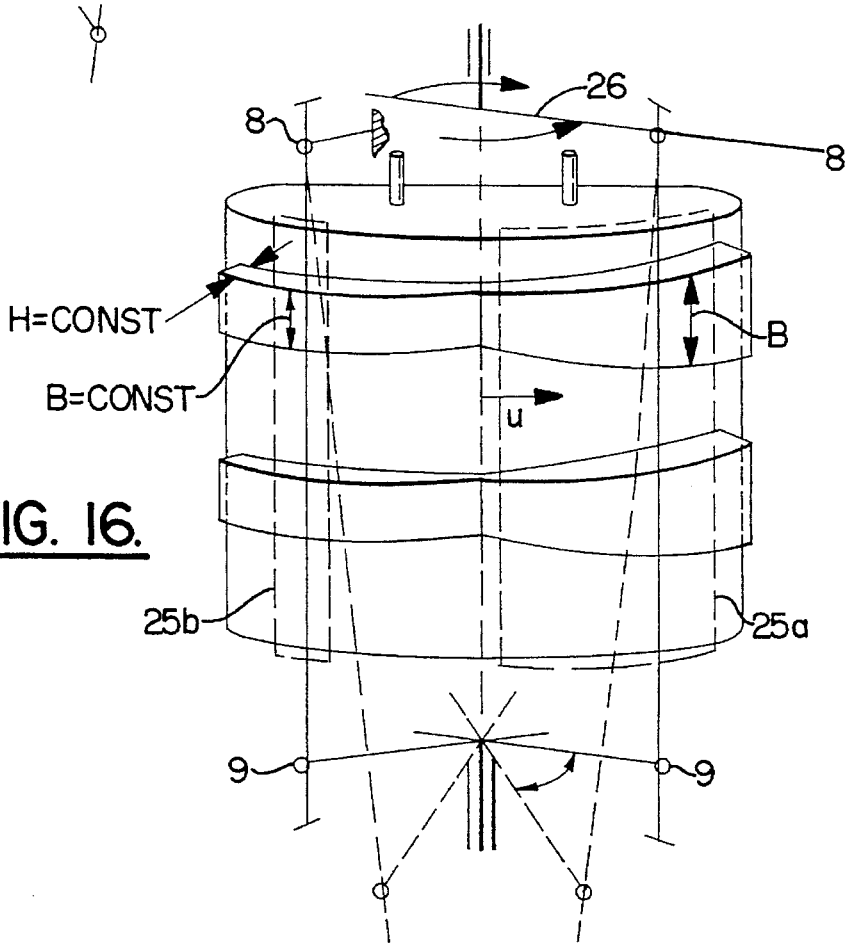
Figure 17:
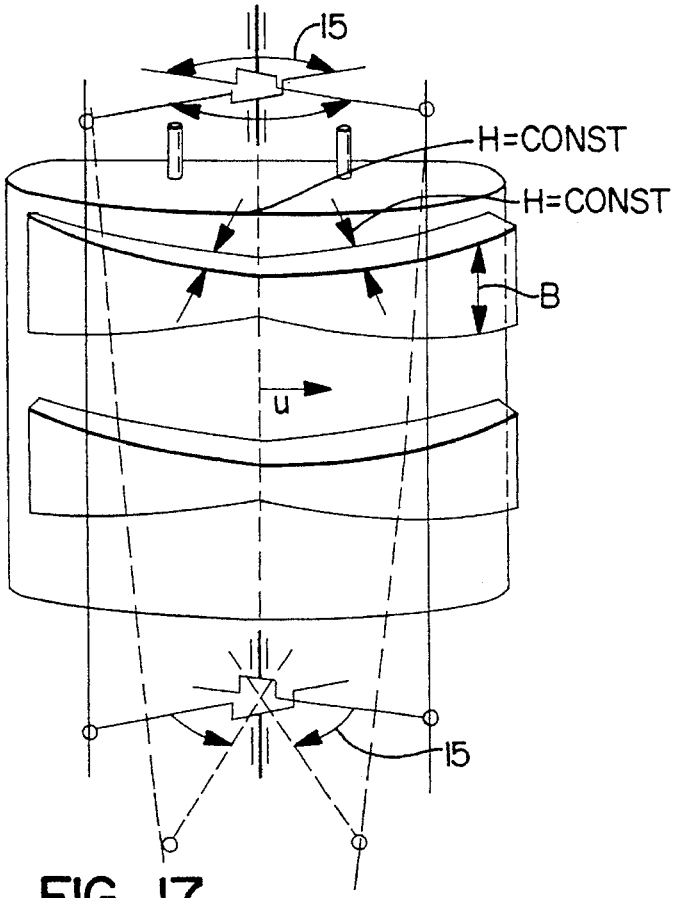

FIGS. 15–17 illustrate likewise embodiments with two yarn heating zones 25 on heater 1.

Mounted on the heated surface in each of yarn heating zones 25*a* and 25*b* are several ridge portions (ring segments 2) axially arranged one following the other in the direction of the advancing yarn, with the height of the rings extending beyond the heated surface by at least 0.1 millimeters, but no more than 5 millimeters.

Thus, it matters that the height of the rings 2 above the heated surface does not amount to more than about 5 millimeters, so as to utilize the advantages of this heater in accordance with the invention, in particular the selfcleaning and the sensitive adjustability.

The width B of rings 2 changes in the circumferential direction. It should explicitly be stated that this can be of advantage in accordance with the invention, alone or in combination with a height M of the rings, which changes in the circumferential direction. In the latter instance, the height should decrease as the width increases, if an intensification of the heating effect is desired by shifting the yarn path to the range of greater width.

In the embodiment of FIG. 15, the width increases from a generatrix of heating tube 1 toward both sides, Thus, when one yarn 7 advances on both sides of the generatrix, a relative rotation of the tube in the same direction with respect to these yarn paths will result in an opposite change of the heating effect for the two yarns. This may be desired. If undesired, it is provided that the inlet yarn guides 8 and 9, which are respectively associated to one yarn path, are adjusted separately from the yarn guides of the other yarn path in the circumferential direction of the heating tube. To this end, the yarn guides 8 and 9 are supported on levers which are rotatable about the axis of the heating tube. As shown in FIG. 16, it may also be meaningful to provide only one of the yarn heating zones with rings, whose width B changes in circumferential direction, and analogously to the foregoing description likewise their height H, whereas the ring width B and ring height H are constant in the other of the two yarn heating zones.

In this instance, it is not necessary to provide for the one (left) yarn path a relative adjustability between inlet yarn guide 8 or respectively outlet yarn guide 9 and the heating tube.

However, for the other (right) yarn path a relative adjustment between heating tube and yarn path is possible, for example, by adjusting the associated yarn guides 8 and 9. This adjustment allows to adapt the heating action on the one yarn to the heating action on the other yarn.

In all embodiments of the present invention, in which a relative adjustment occurs between the heating tube and the yarn path, it is possible to perform this relative adjustment in circumferential direction on the one hand by rotating the tube when the yarn path is stationary. In false twist crimping machines, this is the more obvious solution, since the yarn path is defined by the machine geometry, and a change in the yarn path has negative effects on the yarn tension and other process parameters. In other cases, however, it is possible to effect the relative adjustment in that the yarn paths are associated respectively with synchronously movable inlet yarn guides 8 or outlet yarn guides 9, which are arranged in the end zones of rotatable levers 26. However, a change in the heating effect is also possible by the relative adjustment of the yarn guides, i.e., by changing the slope of the threadline.

To attain the synchronous rotatability, it possible to connect the yarn guide levers via a gearing. This is accomplished in the embodiment of FIG. 16 in that the yarn qualities of two yarns advancing over a heater are identical with one another, or are on purpose differently adjusted. As regards the embodiment of FIG. 17, reference may be made to the description of the embodiments of FIGS. 15 and 16. The characteristic of this embodiment is that with respect to the right yarn path only the ring width increases in circumferential direction, whereas the ring height above the jacket of heating tube 1 remains constant. With respect to the left yarn path, the ring width B increases in circumferential direction and oppositely directed to the other side, whereas the ring height H decreases. In this embodiment, it is useful to adjust the right yarn path and the left yarn path independently of each other by correspondingly adjusting the inlet yarn guides 8 and outlet yarn guides 9, either in the sense of changing the slope of the helix or, however, of a parallel displacement of the helix. This applies furthermore to all embodiments with a changing ring width or ring height. The circumferential displacement of the yarn path allows to vary the heating effect differently. Thus, it is possible to carry out not only an absolute change in the heating effect for each yarn path, but also a relative change in the heating effect and, in connection therewith, a corresponding adaptation to the target temperature to be reached.

FIGS. 18A–E are only a schematic axial view of a heating tube with two rings 2, whose height changes with respect to the jacket of the heating tube in circumferential direction.

This is accomplished in the embodiment of FIGS. 16, in that the rings have the shape of an ellipsis and are arranged concentric to the circular-cylindrical heating tube. This arrangement makes it possible to arrange two yarn heating zones 25*a* and 25*b* diametrically opposed, and to further arrange in this instance the inlet yarn guides 8 or respectively outlet yarn guides 9 on respective levers 26 such that the yarns advance over locations with identical operating conditions. Prerequisite thereto is that both yarns are guided along a helix in the same direction. In this instance, a synchronous movement of the two inlet yarn guides 8 or respectively outlet yarn guides 9 effects a congruent change in the two threadlines and the operating conditions to which the threadline is subjected. The same applies to the synchronous adjustment of the two outlet yarn guides 9. Consequently, it is possible to arrange the pair of inlet yarn guides 8 and the pair of outlet yarn guides 9 respectively on the same lever which is rotatable about the axis of the heating tube.

Figure 18A:
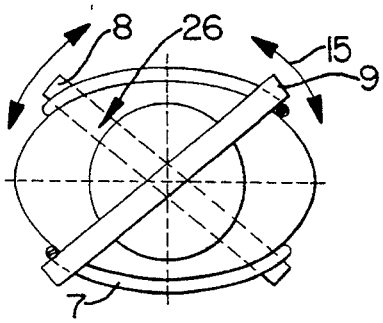
FIGS. 18A–E are top views of heaters with varying height of the ridge portion and two yarn paths.
Figure 18B:
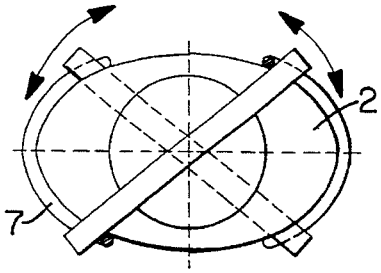
Figure 18C:
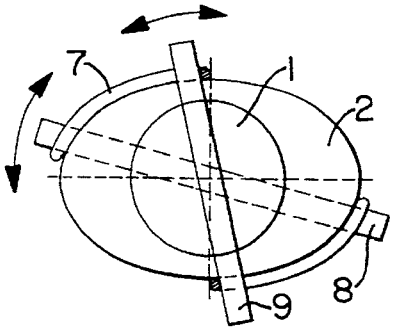

The yarn path shown in FIG. 18C is especially favorable. In this embodiment, each of the yarns 7 advances exclusively within a quadrant extending between a long semiaxis and a short semiaxis of the ellipsis.

It can be noted that in the selected quadrant, the heat transfer from heating tube 1 to the yarn increases continuously over the entire yarn length between inlet yarn guide 8 and outlet yarn guide 9, because when the yarn advances in this quadrant, there is a great distance between the yarn on the inlet yarn guide 8 and the heating tube 1, which notably decreases as the yarn advances in direction toward the outlet yarn guide 9, and assumes its smallest value on outlet yarn guide 9.

The distribution of the heat transfer over the entire length of the yarn advancing between inlet yarn guide 8 and outlet yarn guide 9 becomes thus adjustable in all these embodiments in the same manner as the total amount of the transferred quantity of heat.

In the elliptical embodiment of the rings of FIGS. 18A–C and displacement of the yarn paths within the quadrants selected in accordance with FIG. 18C with the selected slope of the threadline in the same direction, the entire range of rings 2 between the minimum distance in the region of the small semiaxis and the maximum distance in the region of the large semiaxis of the ellipsis is available for this adjustment.

Within this possible line of yarn contact, one will therefore expect a heat transfer which is optimally possible at a certain relative position between inlet yarn guide 8 and outlet yarn guide 9, there being in this instance a heat transfer from the tube to the yarn, which continuously increases in the direction of the yarn.

Consequently, in this embodiment "two opposite points of the ellipses" are understood to be two circumferential ranges of the ellipsis, which are diametrically opposed with respect to the intersection of the long and the short axis of the ellipsis.

Figure 18D:
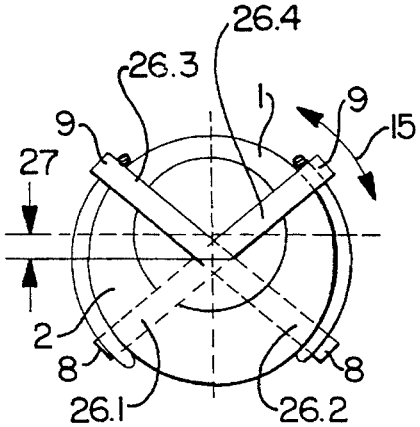
Figure 18E:
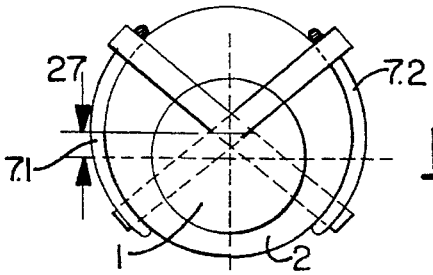

The embodiment of FIGS. 18D and 18E is provided with eccentrically arranged rings 2. The rings 2 are circular, the center of circle of the ridge portion 2 being offset from the center of circle of the heating tube by an eccentricity 72.

The eccentricities of all ring are in this instance located on the same radial side of the axis in a common axial plane of the heating tube 1.

The inlet yarn guide and outlet yarn guide for each yarn are separately arranged respectively on one yarn guide lever 26, and rotatable in circumferential direction with respect to the center of ring 2 in the sense of an identical effect on the heated yarn.

The two yarns 7.1 and 7.2 thus advance along paths whose helices have an opposite pitch.

In this manner, it is accomplished that in the event of a synchronous adjustment of only the inlet yarn guides 8 or only the outlet yarn guides 9, the heat flow on both yarns is influenced in the same manner, i.e. both the distribution of the heat flow over the yarn length exposed to the heating tube and the total amount of the quantity of heat.

As is supplementally shown thereto in FIG. 18E, which illustrates a situation rotated by 180° in accordance with FIG. 18D, it is possible to attain an optimal influence of the heat transfer from the heating tube 1 to the yarn 7.

While in the case of FIG. 18D the yarn entering in the region of inlet yarn guide 8 has a relatively great distance from the heated surface of heating tube 1, and the exiting yarn a relatively small distance in comparison therewith, the conditions are exactly reversed in the case of FIG. 18E.

In the latter, the yarn entering in the region of inlet yarn guide 8 is heated relatively strongly, since it has a very short distance from the heated surface of heating tube 1, whereas the yarn exiting in the region of outlet yarn guide 9 occupies a relatively great distance from the heated surface.

The embodiments of FIGS. 9 to 18 A–E allow to adjust a sensitive heat action on the yarn, which is sensitively adapted to the respective yarn parameters. Therefore, it is also possible to operate always at selfcleaning temperatures on the heating tube and the ridge portions, even with fine deniers in that the contact ratio and/or yarn spacing are adapted to the yarn. Nonetheless, it becomes possible to heat any kind of yarn free of damage.

Primarily, the invention makes it possible to process filament yarns of different deniers, for example 20 denier or respectively 40 denier, with the same heater and at the same time, provided the relative position is adjusted accordingly between the advancing yarn and the heated surface.

All these embodiments thus allow to realize with one and the same heater and without changing or adjusting the temperature of the heated surface, different heat flows and target temperatures alone by the selection of the relative position between the yarn path and the heater. Thus, it is also possible to obtain an adaptation to the respective yarn thickness (denier) and the material (polyester, nylon), or to the respectively desired, different yarn quality.

Up to this point, embodiments of the invention have been described, in which the rings 2 are slipped as individual structural elements onto the heating tube, or are firmly connected therewith and form a part of the heating tube. Referring now to FIGS. 19–22, embodiments are described, in which the rings as a whole form part of an independent structural component. For all embodiments of FIGS. 19–22, the following applies: A sleeve 33 is slipped over the circular-cylindrical heating tube 1. The sleeve 33 is a thin sheet which closely lies against the contour of the heating tube at least in the yarn path and heating zone of the yarn. It may be the segment of a circular cylinder which is secured to the heating tube by springs or tapes. In the embodiments of FIGS. 19–22, the sleeve is a circular cylindrical tube, whose inside diameter corresponds to the outside diameter of the heating tube with a close tolerance. The sleeve carries the rings 2 of the present invention in axial direction. The illustrated embodiments of FIGS. 19–22 differ as regards the configuration of the rings. The sleeve is axially defined by a guideway 45. It is however rotatable. To this end, the sleeve is provided on its circumference with holes 44, into which a suitable tool can be inserted to rotate the sleeve. However, it is also possible to provide a permanent rotary drive for the sleeve of FIG. 19.

Figure 19:
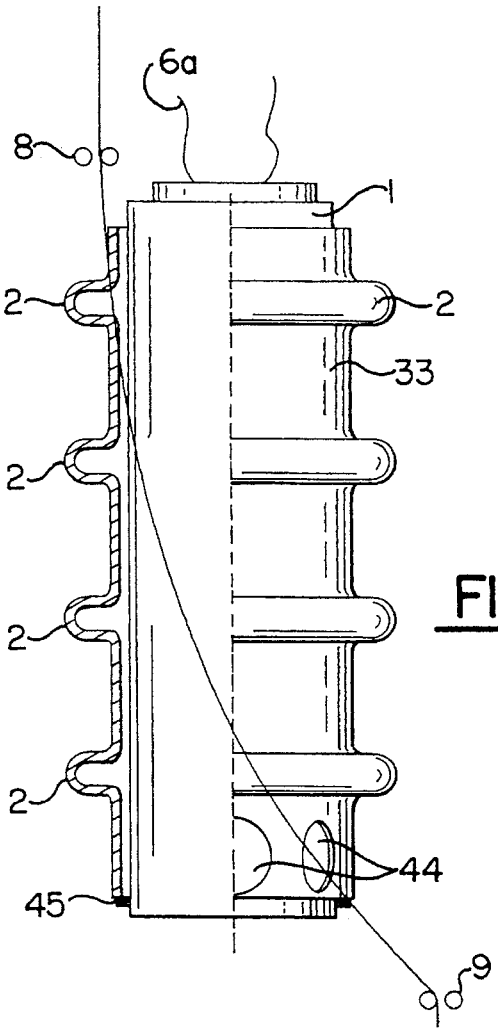
FIG. 19 is a side view of a heater with overlying sleeve and rings.

In the embodiment of FIG. 19, the sleeve is bulged outwardly in several normal planes at least in the region of the yarn path. Such a bulge can be realized, for example, by rolling and/or compressing the tube in axial direction. As a result several bulged rings 2 are formed over the circumference. One or several yarns can advance over the outer circumference.

This embodiment has its special advantage when considerable soiling of the heater is to be expected. In this event, it is possible to rotate at time intervals the sleeve which is symmetrical over the circumference, continuously and slowly by hand, or however by a drive not shown. As a result, the yarn constantly entrains sediments which form on the rings. This allows to considerably increase the time intervals in which the heater is cleaned. The impurities entrained by the yarn are insignificant for the yarn quality.

Figure 20:
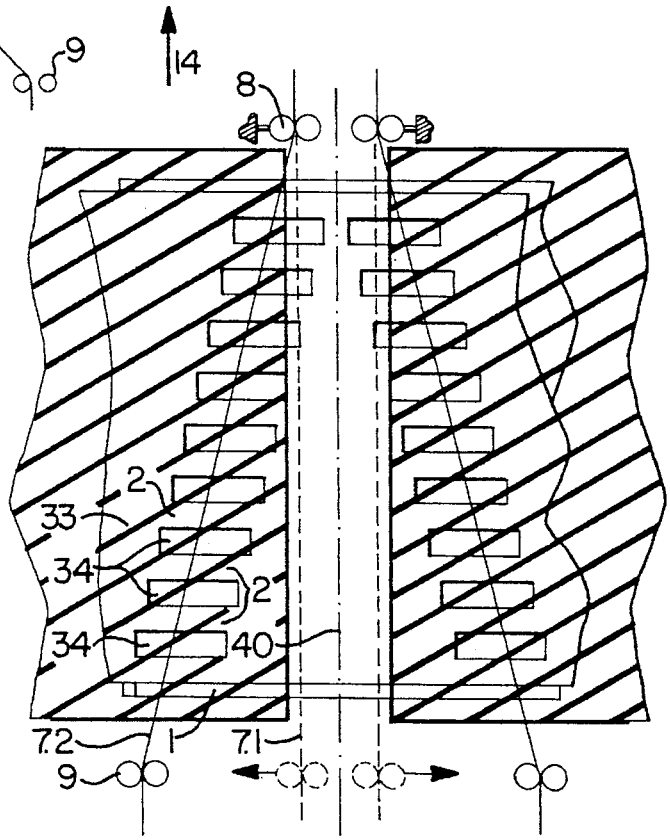
FIG. 20 is a side view of a heater with a sleeve and two yarn paths.

In the embodiment of FIGS. 20 and 21, the sleeve is provided with rings, in that following the desired yarn path, a plurality of recesses 34 are formed in the sheet of the sleeve. The recesses 34 are holes which are provided in the sheet. The embodiment is shown in FIG. 20 as a development which corresponds substantially to the illustration of FIGS. 13A and 13B. Insofar reference is made to their description. However, while in the embodiment of FIGS. 13A, 13B, the rings are a part of the heating tube, the rings in the embodiment of FIG. 20 are formed by the aforesaid recesses 34. The latter extend over a partial circumference of the sleeve. The axially successive recesses 34 are offset, following the central intended threadline, by a certain angular amount in the circumferential direction of the sleeve. The recesses 34 are rectangles, whose longitudinal edges directing in the circumferential direction lie each in a normal plane. Consequently, between adjacent recesses 34 ridge-shaped ring segments remain which are effective as rings 2 in the meaning of the present invention. In the embodiment of FIG. 20, two rows of recesses 34 are successively arranged with an opposite axial offset symmetrical to the center line 40, so that for the respectively associated inlet yarn guides 8 and outlet yarn guides 9 two yarns can be guided over the recesses or rings. The circumferential extension of the recesses is selected so large that it is possible to adjust the desired yarn paths.

Figure 21A:
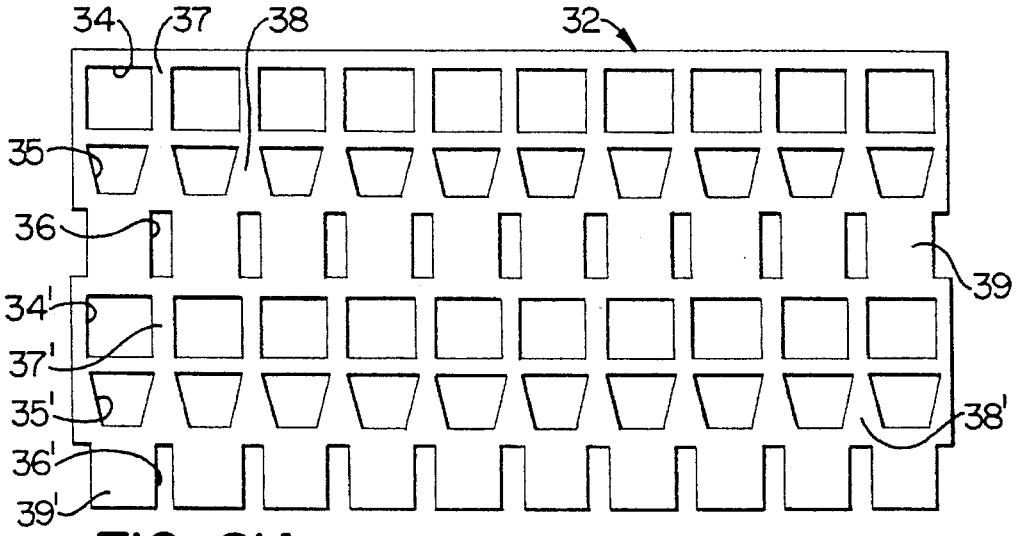
FIGS. 21A–B are a front view of a sleeve and a perspective view of a heater, with the sleeve having different shapes of recesses.
Figure 21B:
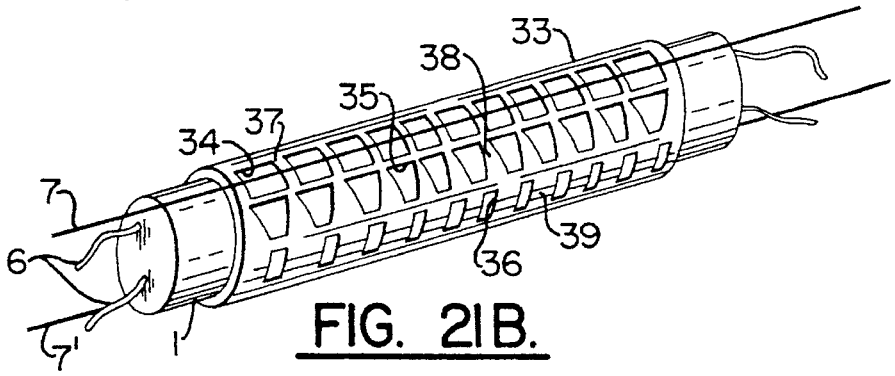

In the embodiment of the invention shown in FIGS. 21A–B, the sleeve 33 is likewise formed as a hollow cylinder and placed as such on the heating tube 1, with the inside diameter of the hollow cylinder corresponding with a close tolerance to the outside diameter of the heating tube. The cylinder, hereinafter sleeve 33, is secured on the heating tube 1 against axial displacement, but can be rotated about same, the rotational movement being dependent, if need be, on the disengagement of a blocking member not shown. In the illustration of FIG. 21B, two yarns advance on opposite sides along the sleeve. The associated inlet yarn guides 8 and outlet yarn guides 9 are not shown so as to not adversely affect the clarity. Accordingly, the yarns are not shown in the helical pattern which they form during the operation, but only schematically and axis parallel. However, for the guidance of the yarns the same applies, as already described above. To this end, reference is made in particular to the description of the embodiment shown in FIG. 20.

In comparison therewith, the embodiments of FIGS. 21A–B have the following characteristics: the recesses 34 are arranged in a row extending parallel to the axis of heating tube 1, and form between them ring segments 2 of identical width. The ring segments 2 serve as ridge portions for guiding one of the yarns 7, and are equally wide in axial direction. The fact that the sleeve 33 can be rotated about the heating tube 1, offers the possibility of having the yarn 7 advance in the circumferentially extending region of the ridge portions 32 respectively over a clean point, thereby further increasing the selfcleaning effect of the ridge portions, which exists per se in accordance with the aforesaid temperatures. A row of identically shaped recesses 34 is diametrically opposed to the recesses 34 in the yarn path for the second yarn 7.

In circumferential direction, next to the row of rectangular recesses 34, is a further row of recesses 35 which are trapezoidal in the illustration. These recesses form between them wedge-shaped ring segments, here indicated at 38. Diametrically opposite to this row is an identical arrangement of trapezoidal recesses 35 and respectively wedge-shaped ring segments for the second yarn. Thus, the possibility is given to change the length of heating surfaces, which is in contact with the yarn, by a simple rotation of sleeve 33 about the heating tube 1.

In circumferential direction, next to the row of trapezoidal recesses is a further row of successive recesses 36. They are recesses which are relatively narrow in axial direction, but leave instead wide ring segments 2 between them, which offer as yarn guiding ridge portions a larger contact surface to the yarn 7. Corresponding to the other recesses, also in the case of recesses 36, a row of recesses 36 diametrically opposite thereto with corresponding ring segments is provided, which form the second yarn contact path.

FIG. 19 is an enlarged view of the sleeve as a development. The recesses of each row are of identical shape and equally spaced apart from on another. Between the rows, ring segments are arranged, which extend in circumferential direction. The ridge portions which remain in the circumferential direction of sleeve 32 between the respective rows of recesses, are of importance for the rigid structure of the sleeve, but beyond that they exert only an influence on an even heat distribution.

The sleeve jacket measures from 0.1 mm to 5 mm thick (in practice 0.3 mm), preferably from 0.5 mm to 3 mm. This allows to accomplish that also in this embodiment, the radial distance between the jacket surface of heating tube 1 and the surface of the ring segments corresponds to the above-indicated dimensions of the ring height, and is within the discussed, preferred ranges from 0.1 mm (in practice 0.3 mm) to 5 mm, preferably 0.5–3 mm.

The sleeve 33 may be provided with recesses of a different shape, which satisfy operating conditions and meet with other desired operating conditions.

The sleeve is an inexpensive structural component which can easily be installed and removed. The shape of the recesses and, thus, the configuration of the rings or respectively ring segments is unlimited within the structure of the sleeve. Therefore, it should be considered in this embodiment as a special advantage that the configuration of the sleeve can be adapted with respect to contact ratio (width of ring segments/width of recesses respectively in the direction of the advancing yarn), and number and distribution of rings, to each individual case of application (yarn denier, speed of advancing yarn, yarn material, target temperature, and others).

Figure 22A:
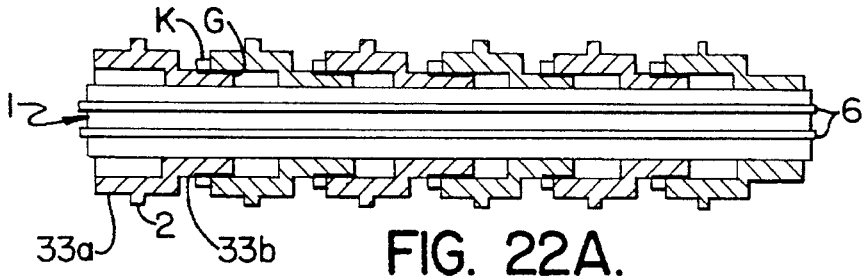
FIGS. 22A–B show heaters with telescopically displaceable sleeves.
Figure 22B:
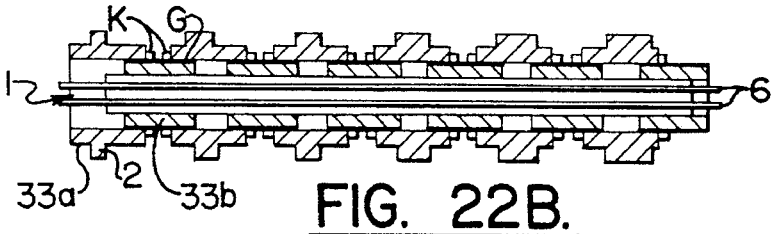

The embodiments of the invention as shown in FIGS. 22A–B have the common feature that the sleeve which carries the yarn guiding ridge portions or respectively rings 2, is composed of tubular sections 33.

The sections following one after the other in axial direction are in both embodiments adapted to slide into each other like a telescope. To this end, two successive sections face each other with ends, of which the outside diameter of the one section end corresponds substantially with a close tolerance to the inside diameter of the other section end. The sections are threaded onto the heating tube 1.

In the case of the embodiment shown in FIG. 22A, the sections 33 consist each of an axial section 33*a* with a larger diameter and an axial section 33*b* with a smaller outside diameter, with the latter corresponding to the inside diameter of axial section 33*a* with the larger outside diameter. Suitably, threads G are cut into the inner jacket surface of axial section 33*a* with the larger outside diameter and into the outer jacket surface of axial section 33*b* with the smaller outside diameter, so as to allow to interconnect the individual tube sections 1'. If need arises, the screw connections can be secured by counternuts K, thereby allowing to accurately adjust the position of the sections with respect to one another.

Provided on the outer circumference of each section 33*a* with the larger outside diameter is a ring 2. The embodiment illustrated in FIG. 22B differs from that of FIG. 22A in that successive sections alternate with a smaller and a larger diameter. The outside diameters of the inside sections correspond to the inside diameters of the outside sections. The sections are screwed together by means of outside and inside threads G and are secured in their position relative to one another by counternuts K, if need arises. Each of the large sections is provided on its jacket surface with a ring 2 serving as a yarn guide, with the rings 2 being illustrated with a width increasing in the longitudinal direction of the sleeve.

Otherwise, the foregoing description of the other embodiments also applies to these embodiments of the heater and their yarn guide rings. In particular, it is possible to configure the rings in accordance with the above described embodiments of FIGS. 9–12.

The heater of the present invention is preferably used in a false twist crimping machine. Such a false twist crimping machine is described, for example in DE-PS 37 19 050, and comprises a plurality of feed yarn packages, from each of which a yarn is withdrawn, a heating system, over which each yarn advances, a cooling system, over which each yarn advances, a false twist unit, which imparts a temporary twist to each yarn, as well as feed and delivery systems, which withdraw the yarn from the feed yarn packages or respectively from the false twist unit. Subsequently, each yarn is wound on a takeup package. All heaters of the present invention are usable, in particular as the heater arranged in the false twist zone.

Figure 23:
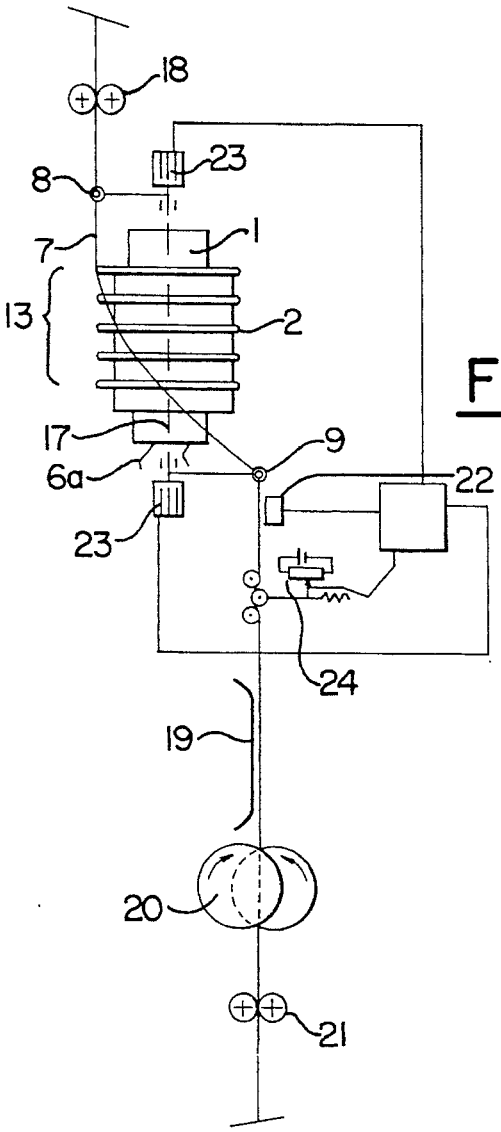
FIGS. 23–24 are each a schematic view of a false twist crimping machine with yarn tension and yarn temperature measuring systems.
Figure 24:
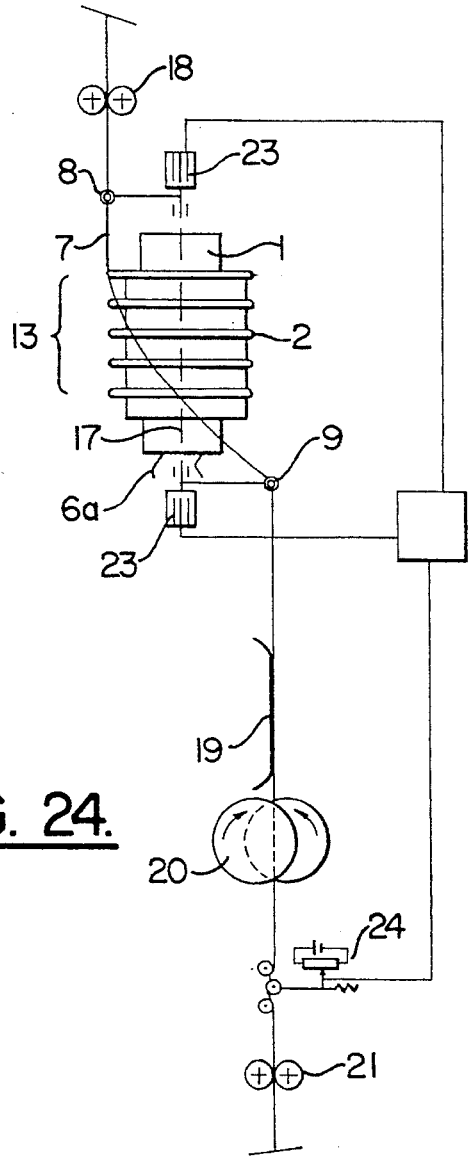

Further shown in FIGS. 23 and 24 is that the inlet yarn guide 8 and the outlet yarn guide 9 are adjustable relative to one another or synchronously in the circumferential direction of the heating tube 1. The yarn guides are adjusted by stepping motors 23. Alternatively, it is also possible to rotate the heating tube. The heating tube is provided with rings which are configured in accordance with FIGS. 9–12. Alternatively, the heating tube can also be surrounded by a sleeve in accordance with FIG. 20 or 21. In any event, the configuration of the rings is such that the contact ratio and/or the height of the rings above the heating surface varies in circumferential direction for all rings to the same or different extent.

In the false twist crimping machine of FIG. 23, the inlet yarn guide 8 and outlet yarn guide 9 are rotated by stepping motor 23 as a function of the yarn temperature measured at the outlet end of the heater.

To this end a temperature sensor 22 arranged in the outlet region of heating tube 1 is used, which emits an output signal, by which the stepping motors 23 are activated, and the inlet yarn guide 8 and outlet yarn guide 9 are displaced as a function of the temperature.

It should explicitly be stated that the measuring signal of temperature sensor 22 may also be superposed with a yarn tension signal, which is generated by a tension measuring device 24, in the present embodiment downstream of the heater.

The embodiment of FIG. 24 may be selected as an alternative. In this false twist crimping machine, the yarn tension is measured by a tension measuring device 24 downstream of friction false twist unit 20. The stepping motors which activate inlet yarn guide 8 and outlet yarn guide 9, are controlled by the output signal of tension measuring device 24, and displaced in circumferential direction. It has shown that the yarn tension which is present during the process downstream of the friction false twist unit, is a measure for all product parameters, which constitute the quality of the crimped yarn. The displacement of the yarn path on the circumference of the heating tube for influencing the heat transfer and the target temperature of the yarn allows to accomplish within limits that the yarn tension downstream of the friction false twist unit remains constant. If these limits are exceeded, other process parameters will have to be readjusted or corrected. As regards the description of FIGS. 23 and 24, false twist machines with heaters of the present invention offer the advantage that the respectively effective heat transfer from the heater to the yarn can be adjusted very sensitively in the meaning of a process optimization, and that, moreover, it is possible to control or adjust the yarn temperature very accurately, so as to achieve an optimal yarn quality over the entire length of the yarn path.

We claim:

1. A heater for heating an advancing thermoplastic yarn comprising a heating tube having opposite ends and comprising an outer surface having a curvilinear cross-section normal to the longitudinal axis of said tube, the outer surface of said tube defining a heating surface;

means for heating the outer surface of said tube;

a plurality of ring segments mounted on said outer surface and extending at least partially around the circumference of said tube, the ring segments defining outer ridge portions with outer diameters;

a yarn guide mounted at each of said ends of said tube, said yarn guides being offset in relation to each other in the direction of the circumference of said tube, said yarn guides cooperating with each other to guide the advancing thermoplastic yarn helically along said tube such that the thermoplastic yarn contacts the outer ridge portions of said ring segments at the outer diameter without contacting the outer surface of said tube.

2. A heater as in claim 1 wherein said ring segments comprise a spiral bead helically surrounding said tube.

3. A heater as in claim 1 wherein the outer surface of said tube has a plurality of axially spaced-apart recesses formed therein which extend at least partially around the circumference of said tube, the outer surface between successive recesses defining said ring segments for supporting the thermoplastic yarn above the outer surface.

4. A heater as in claim 3 wherein each of said recesses is between about 0.1 mm and about 5 mm deep.

5. A heater as in claim 1 wherein the radial thickness of each of said ring segments is between about 0.1 mm and about 5 mm.

6. A heater as in claim 1 wherein the outer surface of said tube is threaded, and said ring segments comprise annular rings having a threaded interior surface, the interior surface of said annular rings being threadably engaged with the outer surface of said tube.

7. A heater as in claim 1 wherein each of said ring segments has a radial slot formed therein which extends from the inner circumference to the outer circumference of said ring segment, each slot having a width equal to at least the diameter of said tube, the slots of axially spaced-apart, adjacent ring segments offset angularly around the circumference of said tube by a predetermined amount which corresponds to the helical angle of the advancing thermoplastic yarn.

8. A heater as in claim 7 wherein each of said ring segments comprises a forward facing side and a rearward facing side, and at least a plurality of said ring segments has an axial recess formed in the rearward facing side which extends at least partially therethrough and a pin which extends axially outward from the forward facing side thereof which engages the axial recess on the rearward facing side of an adjacent ring segment, each pin being offset relative to the radial slot angularly around the circumference of said tube by a predetermined amount such that the slots of the axially spaced-apart, adjacent ring segments lie substantially on a spiral line which corresponds to the helical angle of the advancing thermoplastic yarn, and wherein said ring segments are axially spaced-apart by said pins.

9. A heater as in claim 8 wherein each of said ring segments has a plurality of axial recesses in the rearward facing side extending at least partially therethrough and forming a portion of a circle concentric with said tube, each of said pins in receiving engagement with one of said recesses in the rearward facing side of an adjacent ring segment and offset angularly around the circumference of said tube by a predetermined amount which corresponds to the helical angle of the advancing thermoplastic yarn.

10. A heater as in claim 7 further comprising a spring clip adapted for slidably engaging the sides of the slot of each ring segment and resiliently engaging the outer surface of said tube to thereby secure said ring segment to said tube.

11. A heater as in claim 1 further comprising a sheet-shaped sleeve congruent with and extending over the outer surface of said tube, said sleeve rotatable around the circumference of said tube; and wherein said ring segments comprise bulges axially spaced-apart on said sleeve.

12. A heater as in claim 11 wherein said sleeve comprises a plurality of adjustable interconnected sections engaged in telescoping relation.

13. A heater as in claim 1 further comprising a sheet-shaped sleeve congruent with and extending over the outer surface of said tube, said sleeve having a plurality of axially spaced-apart recesses formed therein which extend at least partially around the circumference of said tube, the portions of said sleeve between successive recesses defining said ring segments for supporting the thermoplastic yarn above the heating surface.

14. A heater as in claim 1 wherein at least one of said yarn guides is adapted for displacement relative to the other yarn guide in the direction of the circumference of said tube.

15. A heater as in claim 1 wherein said heater further comprises a corresponding plurality of yarn guides at each opposed end of said tube, each said yarn guide cooperating with an opposed yarn guide to guide one of a plurality of thermoplastic yarns helically along said tube such that each thermoplastic yarn contacts the outer ridge portions of said ring segments without contacting the outer heating surface of said tube.

16. A heater as in claim 15 wherein said yarn guides are positioned such that a pair of thermoplastic yarns are advanced along and spaced-apart from said tube in opposite directions of looping and at a distance which varies in the circumferential direction of said tube, each of said yarns having a looping angle less than 180 degrees, said heater further comprising an insulating jacket surrounding said tube and provided with a narrow threading slot which extends parallel to the longitudinal axis of said tube between said pair of advancing thermoplastic yarns.

17. A heater as in claim 1 wherein said ring segments define a length in the direction of the longitudinal axis of said tube which varies in the circumferential direction of said tube; and at least one of said yarn guides is adapted for displacement relative to said tube in the direction of the circumference of said tube such that a contact ratio defined as the ratio between the length of the thermoplastic yarn which contacts each said ring segment and the length of the thermoplastic yarn between each said ring segment and an axially spaced-apart, adjacent ring segment is adjustable.

18. A heater as in claim 1 wherein said ring segments define a height in the radial direction normal to the longitudinal axis of said tube which varies in the circumferential direction of said tube; and at least one of said yarn guides is adapted for displacement relative to said tube in the direction transverse to the direction of the longitudinal axis of said tube such that the distance of the thermoplastic yarn from the outer heating surface is adjustable on said ring segments.

19. A heater as in claim 18 wherein the contour of at least a portion of the outer periphery of said ring segments is substantially elliptical, the center of the ellipse defining the elliptical portions coincident with the longitudinal axis of said tube; and wherein said yarn guides are configured to advance a pair of opposed thermoplastic yarns linearly along and spaced-apart from said tube at equal angles of inclination.

20. A heater as in claim 18 wherein the contour of at least a portion of the outer periphery of said ring segments is eccentric relative to the longitudinal axis of said tube and axially adjacent ring segments are offset by 180 degrees; and wherein said yarn guides are configured to advance a pair of thermoplastic yarns linearly along and spaced-apart from said tube at opposed angles of inclination on opposed sides of the axial plane of said tube on which the centers of said ring segments are located.

21. A heater as in claim 17 wherein axially spaced-apart, adjacent ring segments are offset in the direction of the circumference of said tube in accordance with the line of contact of the thermoplastic yarn on said ring segments.

22. A heater as in claim 17 wherein at least one of said yarn guides is adapted for displacement relative to said tube as a function of the temperature of the thermoplastic yarn at the exit end of said heater such that the temperature of the thermoplastic yarn remains substantially constant at a predetermined input value as a result of adjusting the contact ratio.

23. A heater as defined in claim 18 wherein at least one of said yarn guides is adapted for displacement relative to said tube as a function of the temperature of the thermoplastic yarn at the exit end of said heater such that the temperature of the thermoplastic yarn remains substantially constant at a predetermined input value as a result of adjusting the distance of the thermoplastic yarn on said ring segments from the outer heating surface.

24. A heater as in claim 17 wherein at least one of said yarn guides is adapted for displacement relative to said tube as a function of the tension of the thermoplastic yarn at the exit end of said heater such that the temperature of the thermoplastic yarn remains substantially constant at a predetermined input value as a result of adjusting the contact ratio.

25. A heater as defined in claim 18 wherein at least one of said yarn guides is adapted for displacement relative to said tube as a function of the tension of the thermoplastic yarn at the exit end of said heater such that the temperature of the thermoplastic yarn remains substantially constant at a predetermined input value as a result of adjusting the distance of the thermoplastic yarn on said ring segments from the outer heating surface.

26. A heater as in claim 1 wherein said heater is installed in a false twist crimping machine which includes a yarn feed system positioned upstream of said heater and a cooling plate, a friction false twist unit and a delivery system positioned downstream of said heater.

27. A heater as in claim 1 wherein said outer ridge portion of each of said ring segments is convexly curved when viewed in transverse cross section.

28. A heater as in claim 1 wherein said heating means comprises at least one axially extending heating resistor positioned in the interior of said heating tube.

29. A heater as in claim 1 wherein said ring segments are non-movable with respect to the heating tube during the heating of an advancing yarn.

30. A heater as in claim 29 wherein at least one of said yarn guides is pivotable about the longitudinal axis of the heating tube, and wherein the heater is characterized by the absence of additional yarn guides along the length of the tube acting to control the helical yarn path of travel, so that the helical yarn path of travel over the entire length of the tube may be controlled by pivotal movement of said one guide.

* * * * *